US006129602A

United States Patent [19]

Yamanobe

[11] Patent Number: 6,129,602

[45] Date of Patent: Oct. 10, 2000

[54] METHODS OF FABRICATING AN ELECTRON EMISSION DEVICE COMPRISED OF A METAL NUCLEUS, A CARBON COATING, AND A LOW-WORK-FUNCTION MATERIAL AND A METHOD OF FABRICATING AN IMAGE DISPLAY DEVICE UTILIZING THIS ELECTRON EMISSION DEVICE

[75] Inventor: Masato Yamanobe, Machida, Japan

[73] Assignee: Canon Kabushiki Kaisha, Tokyo, Japan

[21] Appl. No.: 09/468,940

[22] Filed: Dec. 22, 1999

Related U.S. Application Data

[62] Division of application No. 08/961,277, Oct. 30, 1997, Pat. No. 6,008,569.

[30] Foreign Application Priority Data

Oct. 31, 1996 [JP] Japan ..... 8-290205
Oct. 29, 1997 [JP] Japan ..... 9-297107

[51] Int. Cl.[7] ..... H01J 9/02

[52] U.S. Cl. ..... 445/24; 445/51

[58] Field of Search ..... 445/24, 50, 51

[56] References Cited

U.S. PATENT DOCUMENTS

| | | | |
|---|---|---|---|
| 4,717,855 | 1/1988 | Zwier et al. | 313/409 |
| 5,066,883 | 11/1991 | Yoshioka et al. | 313/309 |
| 5,180,951 | 1/1993 | Dworsky et al. | 315/169 |
| 5,285,129 | 2/1994 | Takeda et al. | 313/346 |
| 5,442,256 | 8/1995 | Moyer et al. | 313/496 |
| 5,463,271 | 10/1995 | Geis et al. | 314/346 |
| 5,499,970 | 3/1996 | Kumar et al. | 313/495 |
| 5,532,544 | 7/1996 | Yoshioka et al. | 313/310 |
| 5,576,051 | 11/1996 | Takeda et al. | 427/77 |
| 5,591,061 | 1/1997 | Ikeda et al. | 445/51 |
| 5,961,362 | 10/1999 | Chalamala et al. | 445/59 |

OTHER PUBLICATIONS

Kumar, N., et al., "Development of Nano–Crystalline Diamond–Based Field–Emission Displays," SID Int'l Symposium Digest Technical Paper, pp. 43–46 (1994).

C.A. Spindt, et al., "Physical Properties of Thin–Film Field Emission Cathodes with Molybdenum Cones," Journal of Applied Physics, Dec., 1976 pp. 5248–5263.

*Primary Examiner*—Kenneth J. Ramsey
*Attorney, Agent, or Firm*—Fitzpatrick, Cella, Harper & Scinto

[57] ABSTRACT

An electron emission device can be driven with a low voltage and has an excellent mass production capability. A display device, such as a color flat panel or the like, which uses such electron emission devices has an excellent display quality. The electron emission device includes a first electrode, on which a plurality of fine particles of an electron emission body obtained by terminating carbon bodies formed on metal fine particles, serving as nuclei, with a low-work-function material via oxygen are partially arranged, on a first substrate, and a second electrode where a voltage for drawing electrons from the electron emission body into a vacuum is applied. A metal of the metal fine particles is a catalytic metal. The catalytic metal is an iron-family element, such as Ni, Co, Fe or the like, or a platinum-family element, such as Pd, Ir or Pt. The carbon bodies are made of graphite. The low-work-function material is an alkaline metal or an alkaline earth metal.

8 Claims, 11 Drawing Sheets

METHODS OF FABRICATING AN ELECTRON EMISSION DEVICE COMPRISED OF A METAL NUCLEUS, A CARBON COATING, AND A LOW-WORK-FUNCTION MATERIAL AND A METHOD OF FABRICATING AN IMAGE DISPLAY DEVICE UTILIZING THIS ELECTRON EMISSION DEVICE

This is a divisional of application Ser. No. 08/961,277, filed Oct. 30, 1997, now U.S. Pat. No. 6,008,569.

BACKGROUND OF THE INVENTION

1. Field of the Invention

This invention relates to an electron emission device, a display device, and methods for manufacturing them. More particularly, the invention relates to an electron emission device comprising fine particles of an electron emission body obtained by terminating carbon bodies grown on metal fine particles, serving as nuclei, with a low-work-function material via oxygen, a display device using such devices, and a method for manufacturing the electron emission device.

2. Description of the Related Art

Two types of electron emission devices, i.e., thermionic emission devices, and cold-cathode electron emission devices, have been known. The cold-cathode electron emission devices include field-emission-type electron emission devices, metal/insulator/metal-type electron emission devices, surface-conduction-type electron emission devices, semiconductor-type electron emission devices and the like.

As an example of the semiconductor-type electron emission devices, there is a device developed by Gorkom and others in which a reverse-biased strong electric field is applied to a p/n semiconductor, and electrons are emitted utilizing an avalanche phenomenon. As an example of the field-emission-type electron emission devices, a device described in C. A. Spindt, "Physical property of thin film field emission cathodes with molybdenum cones", J. Appl. Phys., 47, 5248 (1976) is known.

As the field-emission-type electron emission device, a Spindt-type field-emission device including an electron emission body, having a three-dimensionally sharpened distal end, disposed on a conductive substrate, and an electrode called a gate electrode having an aperture for drawing electrons from the electron emission body into a vacuum by generating a high electric field of about $10^7$ V/cm with the distal end of the electron emission body is generally used.

In order to form an image display device, an anode including a phosphor is disposed on an upper surface provided in a direction perpendicular to the substrate. Such an image display device performs display by causing electrons to impinge onto the phosphor to produce light emission by applying a voltage to the anode. Among the field-emission-type electron emission devices, there is a device in which a metal film is two-dimensionally processed into the shape of a triangle or a rectangle, and electrons are emitted from the obtained distal end or corner portion in parallel to a substrate by the electric field between facing electrodes provided on the substrate. Such a device is generally called a lateral-field-emission-type electron emission device.

In these conventional field-emission-type electron emission devices, since the distal end of an electron emission body is sharpened to concentrate the electric field thereon and a high electric field is applied in order to emit electrons, the use of a high-melting-point metallic material which resists against heat and electric field, such as W, Mo or the like, for the electron emission device has been studied. In such a material, there is the problem that the electron emission current changes with time due to deformation of the shape of the distal end of the electrion emission body, i.e., the problem of degradation. Recently, there have been proposals of providing emission current with a low electric field without sharpening the electron emission body by using diamond or the like having a low work function or a negative electron affinity as the electron mission body. Such proposals have been announced, for example, in C. Xie: SID International Symposium Digest Technical paper, pp. 43 (May, 1994), and U.S. Pat. No. 5,180,951.

In U.S. Pat. No. 5,463,271, there is disclosed that electron emission characteristics are improved by providing a low work function by chemically bonding Cs, K, Na, Ba or the like in an electrically positive state using oxygen or fluorine in an electrically negative state on at least 50% of the surface of carbon, preferably, conductive diamond.

Furthermore, there is an attempt to provide a color flat panel by arranging a plurality of these electron emission devices and combining them with a phosphor. In such a flat panel, a plurality of electron emission devices are disposed on a substrate so as to correspond to respective pixels of the phosphor. In order to perform gradation display by selecting arbitrary electron emission devices and controlling the amounts of electron emission of respective devices in accordance with an image signal, the arrangement of the electron emission devices, the phosphor and control electrodes have been devised. For example, as for the above-described semiconductor-type electron emission devices, there is an attempt such that electron emission devices provided on a semiconductor substrate are arranged in the form of a matrix while being combined with control electrodes, and arbitrary electron emission devices are selected and the amounts of electrons are controlled.

In the above-described Spindt-type devices, row-direction wirings are provided on a substrate, electron emission devices are provided on the row-direction-wirings, control electrodes (the above-described gate electrodes) orthogonal to the row-direction wirings are provided in the column direction, and the amount of electron emission is controlled while selecting an electron emission device positionded at the cross point of a row-direction wiring and a column-direction wiring. By accelerating electrons drawn in a vacuum to impinge onto an anode having a phosphor disposed so as to face the substrate, a display device for emitting light from the phosphor is obtained.

In the literature by C. Xie cited above in which diamond or the like having a low work function or a low electron affinity is used, and U.S. Pat. No. 5,449,970, display devices are disclosed in which row-direction wirings are provided on a substrate, a phosphor facing the substrate is provided on column-direction wirings, diamond thin films are partially provided on the row-direction wirings at respective cross points of the row-direction wirings and the column-direction wirings, and electron emission devices are selected and controlled.

However, among the above-descrived electron emission devices, the Spindt-type device has the problem that it is difficult to reproducibly perform three-dimensional processing of sharpening the distal end of the electron emission body from the viewpoint of mass production capability. In addition, since it is necessary to perform very-fine submicron-order processing of the aperture of the gate electrode in order to perform modulation at a lower voltage, there is a problem in reproducibility. In the case of using diamond as the electron emission body, the above-described unique display panel can be provided because diamond has a low work function or a negative electron affinity and can therefore emit electrons at a low electric field. However, since diamond, serving as the electron emission body, is formed according to laser ablation or the like, there arise problems of difficulty in obtaining a large area, controllability of the shape and the density of diamond, control of the physical properties of the surface of diamond, and the like, thereby causing a problem in uniformity. Hence, this type of device is not yet practically used.

SUMMARY OF THE INVENTION

It is an object of the present invention to provide an electron emission device which, in particular, can be driven at a low voltage, and has a high uniformity and an excellent mass production capability, an image display device, such as a color flat panel or the like, having an excellent display quality which uses the electron emission devices, and methods for manufacturing these devices.

According to one aspect, the present invention which achieves the above-described object relates to an electron emission device including a first electrode in which a plurality of fine particles of an electron emission body obtained by terminating carbon bodies formed on metal fine particles, serving as nuclei, with a low-work-function material via oxygen are partially arranged on a first substrate, and a second electrode where a voltage for drawing electrons from the electron emission body into a vacuum is applied.

According to another aspect, the present invention which achieves the above-described object relates to a method for manufacturing an electron emission device, including the steps of (1) applying a solution containing an organic metal on an electrode disposed on a substrate, and then heating the solution in a desired atmosphere to cause thermal decomposition, and to generate metal fine particles, or fine particles including carbon fine particles and metal fine particles, (2) generating carbon bodies by introducing a material including carbon to the substrate and decomposing the material, (3) terminating surfaces of the carbon bodies with oxygen by heating the substrate or generating a plasma in an atmosphere including oxygen, (4) coating the metal/carbon fine particles with a low-work-function material by introducing the low-work-function material to the substrate, and (5) heating the substrate.

According to still another aspect, the present invention which achieves the above-described object relates to an image display device including m first wirings disposed on a first substrate, and n second wirings where a voltage for drawing electrons into a vacuum is applied. The first wirings and the second wirings are substantially orthogonal to each other. The above-described electron emission devices are disposed at cross points of the first wirings and the second wirings.

According to yet another aspect, the present invention which achieves the above-described object relates to a method for manufacturing a display device, including the steps of (1) forming first wirings on a first substrate, then applying a solution containing an organic metal on the first wirings followed by heating the liquid to cause thermal decomposition (also called firing), and to form metal fine particles, or fine particles including carbon fine particles and metal fine particles, (2) forming second wirings and a phosphor on a second substrate, (3) forming a vacuum container by supporting the first substrate and the second substrate by a supporting frame, (4) forming carbon bodies by introducing a material including carbon on the first substrate and decomposing the material, (5) causing the inside of the vacuum container to be an atmosphere including oxygen, and heating or generating a plasma to terminate the surfaces of the carbon bodies with oxygen, (6) coating the metal/carbon fine particles with a low-work-function material by introducing the low-work-function material to the vacuum container, (7) heating the vacuum container while evacuating it, and (8) sealing the vacuum container.

The foregoing and other objects, advantages and features of the present invention will become more apparent from the following description of the preferred embodiments taken in conjunction with the accompanying drawings.

BRIEF DESCRIPTION OF THE DRAWINGS

FIGS. 7(*b*) and 7(*c*) are plan views of the image display device shown in FIG. 7(*a*);

FIGS. 8(*b*) is a plan view of the image display device shown in FIG. 8(*a*);

DESCRIPTION OF THE PREFERRED EMBODIMENTS

Figure 1A:
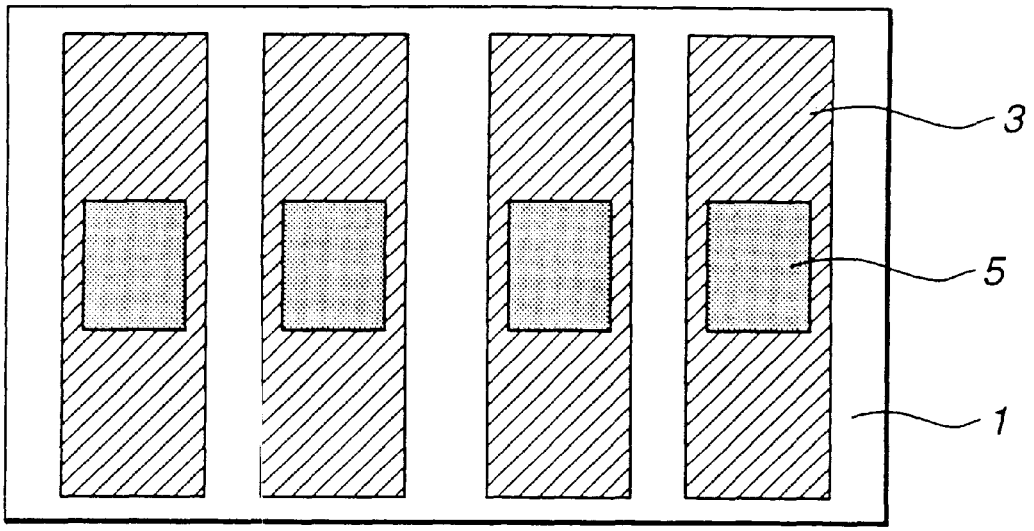
FIGS. 1(*a*) and 1(*b*) are schematic diagrams illustrating a first configuration of electron emission devices according to the present invention.

A description will now be provided of preferred embodiments of the present invention.

An electron emission device according to the present invention includes an eletrode where a plurality of fine particles of an eletron emission body, obtained by coating carbon bodies formed on metal fine particles, serving as nuclei, with a low-work-function material via oxygen, are disposed, and an electrode where a voltage for drawing electrons from the electron emission body into a vacuum is applied.

In more detail, in the electron emission device of the present invention, carbon bodies are formed on previously formed metal fine particles, serving as nuclei. A plurality of fine particles of an electron emission body obtained by terminating the carbon bodies with a low-work-function material via oxygen are partially disposed on a first electrode on a first substrate in a desired form. The device also includes a second electrode where a voltage for drawing electrons from the emission body into a vacuum is applied.

The second electrode where the voltage for drawing electrons from the electron emission body into a vacuum is disposed on a second substrate so as to face the first electrode on the first substrate.

In another configuration, the second electrode where the voltage for drawing electrons from the electron emission body into a vacuum is disposed on a supporting member for electrically insulating the second electrode from the first electrode on the first substrate, and a third electrode for accelerating electrons is also disposed.

Preferably, the metal of the metal fine particles is a metal which operates as a catalyst when forming the carbon bodies, i.e., an iron family element, such as Ni, Co, Fe or the like, or a platinum family element, such as Pd, Ir or Pt. The carbon body is graphite (including so-called HOPG (high oriented pyrolytic graphite) PG (pyrolitic graphite) and GC (glassy carbon), where HOPG has a nearly complete graphite crystal structure, PG has a somewhat disturbed crystal structure having a cystal grain of about 200 Å, and GC has a more disturbed crystal structure having a crystal grain of about 20 Å), or noncrystalline carbon (including amorphous carbon, and a mixture of amorphous carbon and the above-described microcrystalline graphite). The low-work-function material is an alkaline metal or an alkaline earth metal, such as K, Rb, Cs, Ca, Sr, Ba or the like.

It is preferable that the material for the first electrode differs from the metal material of the metal fine particles, and that a resistor, serving as a current limiting resistor, is provided between the first electrode and the metal fine particles.

Although the particle size of the fine particles of the electron emission bodies depends on the particle size of the metal fine particles, it is preferable that the particle size and the density of metal fine particles is 3–100 nm and $10^9$–$10^{11}$ particles/$cm^2$, respectively, and the distance between the metal fine particles is at least equal to the particle size of the metal fine. particles. The particle size, the density and the material of the metal fine particles are appropriately set. It is preferable that thickness of the layer of the carbon bodies is equal to or less than a few atomic layers.

The thickness of the low-work-function material is preferably equal to or less than a few atomic layers, and more preferably, equal to or less than one atomic layer.

According to the electron emission device of the present invention, since fine particles of an electron emission body obtained by terminating carbon bodies formed on metal fine particles, serving as nuclei, with a low-work-function material via oxygen are partially disposed on an electrode on a substrate in a desired form, stable and low-work-function fine particles operate as electron emission bodies. Hence, electrons can be emitted at a low electric field. In a configuration wherein an electrode where a voltage for drawing electrons from the electron emission body into a vacuum is applied is disposed so as to face the electron emission body, also, low-voltage driving can be realized. Furthermore, since the metal of the metal fine particles is a metal which operates as a catalyst when forming carbon bodies, i.e., an iron family metal, such as Ni, Co, Fe or the like, or a platinum family metal, such as Pd, Ir or Pt, it is possible to grow graphite, operating as stable carbon bodies, on metal fine particles, serving as nuclei, at a low temperature. In addition, by using different materials for the first electrode and the metal fine particles, carbon bodies can be selectively formed on regions where the metal fine particles are formed.

Since the carbon bodies are bonded with an alkaline metal or an alkaline earth metal, such as K, Rb, Cs, Ca, Sr, Ba or the like, via oxygen, stable low-work-function electron emission members can be provided.

A preferred specific method for manufacturing the electron emission device of the present invention includes the following processes.

(1) A process of applying a solution containing an organic metal on an electrode disposed on a substrate, and then heating the applied solution in a desired atmophere to cause thermal decomposition (also called firing) and to form metal fine particles, or fine particles including carbon fine particles and metal fine particles on the electrode.

(2) A process of forming carbon bodies on the metal fine particles, serving as nuclei, by introducing a material including carbon onto the substrate and decomposing the material by heat or the like.

(3) A process of heating the substrate or generating a plasma in an atmosphere including oxygen to terminate oxygen on the surfaces of the carbon bodies.

(4) A process of introducing a low-work-function material onto the substrate and coating the fine particles made of the metal and carbon with the low-work-function material.

(5) A process of heating the substrate.

Although in the above-described process (1), a spinner coating method or an ink-jet method is used for providing the substrate with the solution including the organic metal, the ink-jet method is preferable from the viewpoint of efficiently and precisely controlling fine solution droplets. By providing the substrate with solution droplets according to the ink-jet method, a desired pattern can be formed.

The density, the particle size, and the interparticle distance of the metal fine particles are controlled by the density of the metal component of the solution containing the organic metal, the shape of solution droplets, the temperature of the thermal decomposition process, and the like. Still larger fine particles may be formed by coagulating the metal fine particles by heating them in a vacuum or in a hydrogen atmophere after forming the metal fine particles.

In the above-described process (2), a saturated hydrocarbon expressed by a composition formula of $C_nH_{2n+2}$, such as methane, ethane, propane or the like, an unsaturated hydrocarbon expressed by a composition formula of $C_nH_{2n}$, such as ethylene, propylene or the like, or a cyclic hydrocarbon, such as benzene or the like, is used as the material including carbon. A dilution gas may also be appropriately used. A hydrogen gas, a fluorine containing gas or the like, or an inert gas, such as helium or the like, is used as the dilution gas. The word "heat" indicates heat for heating the substrate (the first substrate). A voltage may be applied between the first electrode and the second electrode during heating.

In the above-described process (3), the atmosphere including oxygen has an appropriate partial pressure of oxygen, a mixture gas of oxygen and an inert gas (helium or the like), or a mixture gas of oxygen and $N_2$. The atmophere may be in a reduced pressure or in the atmospheric pressure. The heating temperature and the partial pressure of oxygen are selected within a range such that the carbon bodies formed in process (2) are terminated with oxygen without being burnt.

In the above-described process (5), the heating temperature is selected within a range such that only a portion of the low-work-function material bonded with oxygen terminating carbon is allowed to remain, and an unbonded portion of the low-work-function material is removed by being evaporated. At that time, by applying a voltage between the first electrode and the second electrode, the electrial energy by applying a voltage and the heat by heating may be used together.

According to the method for manufacturing the electron emission device of the present invention, after applying a solution containing an organic metal on an electrode disposed on a substrate, the solution is heated to cause thermal decomposition in a desired atmosphere (also called firing), and thereby to form metal fine particles, or fine particles including carbon fine particles and metal fine particles. Hence, it is possible to perform thermal decomposition of the solution including the organic metal at a low temperature to form the metal fine particles, to control the density of the metal fine particles by the density of the metal component of the solution containing the organic metal, and to control the particle size of the metal fine particles by controlling the density of the metal of the solution containing the organic metal, the shape of droplets, and the temperature of the thermal decomposition process. Furthermore, since the solution containing the organic metal is provided onto the substrate in the form of solution droplets according to the ink-jet method, the fine particles can be formed only on a desired portion without utilizing photolithography or the like. As a result, an inexpensive manufacturing method having a high uniformity and a high mass production capabililty can be provided.

Since a material including carbon is introduced and decomposed by heat or the like, carbon is formed on metal fine particles, serving as nuclei, in a state in which the metal fine particles are controlled.

Since the substrate is heated or a plasma is generated in an atmophere including oxygen to terminate oxygen on the surfaces of the carbon bodies, and a low-work-function material is introduced to coat the carbon bodies on the metal fine particles, serving as nuclei, the low-work-function material is bonded to the carbon bodies via oxygen. Since the substrate is heated at a temperature selected within a range such that only a portion of the low-work-function material bonded with oxygen terminating the carbon bodies is allowed to remain and an unboded portion of the low-work-function material is removed by being evaporated, a stable film of the low-work-function material is provided with a thickness equal to or less than a few atomic layers.

An image display device according to the present invention includes m first wirings disposed on a first substrate, and n second wirings to where a voltage for drawing electrons from an emission body into a vacuum is applied. The m first wirings and the n second wirings are substantially orthogonal to each other, and the above-described electron emission devices of the present invention are provided on m×n cross points of the first and second wirings.

In a first preferable configuration of the image display device of the present invention, the n second wirings where a voltage for drawing electron from an emission body into a vacuum and a phosphor are disposed on a second substrate facing the first substrate. If necessary, a spacer may be disposed as an anti-atmospheric-pressure supporting member between the first substrate and the second substrate so that the first substrate and the second substrate constitute a part of a vacuum container. In the case of a color image display device, red, green and blue phosphors are disposed on the second substrate in the form of a stripe.

In a second preferable configuration of the image display device of the present invention, the. n second electrodes where a voltage for drawing electrons from an electron emission body into a vacuum is applied are disposed on an electrically insulated supporting member on the m first electrodes, and an electrode having a phosphor where a voltage for accelerating electrons is applied is also provided.

In the first configuration of the image display device of the present invention, the first wirings are selectively scanned in accordance with an image signal, and at the same time a modulating signal is input to the second wirings. Electrons according to the image signal are emitted from electron emission device at each cross point, and the accelerated electrons impinge onto the phosphor at respective pixels of the second wirings, to emit light and thereby to display an image. The distance between the first substrate and the second substrate and the potential for accelerating electrons are appropriately set in accordance with the intensity of the electric field for emitting electrons of the electron emission device and the intensity of light emitted from the phosphor. It is preferable that the distance between the first substrate and the second substrate is 10 $\mu$m–500 $\mu$m, and the potential for accelerating electrons is 100 V–5,000 V. The modulating signal is preferably subjected to pulse-width modulation.

According to the first configuration of the image display device of the present invention, the device includes the first wirings disposed on the first substrate, and the second wirings having the phosphor disposed on the second substrate facing the first substrate, the m first wirings and the n second wirings are substantially orthogonal to each other, and the m×n cross points include the electron emission devices of the present invention. Since respective pixels of the image display device correspond to the cross points of the first wirings and the second wirings, accuracy in complicated alignment between the first substrate and the second substrate is not required. The shape of the light emitting phosphor substantially equals the region where the electron emission body of the electron emission device is provided, because the electron orbit of an electron beam emitted from the electron emission device which reaches the phosphor provided on the second substrate is not widened, so that a high-definition image is displayed. Since the electron emission devices of the present invention can emit electrons at a low electric field, and are stable and very uniform, it is possible to provide an inexpensive display device having an excellent display performace.

In the second configuration of the image display device of the present invention, the second wirings have the role of the above-described gate electrodes where a voltage for drawing electrons from the electron emission devices into a vacuum is applied. Each of the second wirings also has an aperture for passing an electron beam emitted from the corresponding electron emission device. The electrodes having the phosphor are provided on the second substrate facing the first substrate.

The first wirings are selectively scanned in accordance with an image signal, and at the same time a modulating signal is input to the second wiring. Electrons corresponding to the image signal are emitted from the electron emission device at each of the cross points, and phosphors corresponding to respective pixels on the second substrate which accelerates electron beams from the openings emit light to display an image.

If necessary, a spacer may be disposed as an anti-atmospheric-pressure supporting member between the first substrate and the second substrate so that the first substrate and the second substrate constitute a part of a vacuum container. In the case of a color image display device, red, green and blue phosphors are disposed on the second substrate in the form of a stripe. An electrode having the phosphors is common to the phosphor of each color.

According to the second configuration of the image display device of the present invention, the device includes the m first wirings disposed on the substrate, and the n second wirings electrically insulated from the first wirings. The m first wirings and the n second wirings are substantially orthogonal to each other, and the above-described electron emission devices of the present invention are disposed on the first wirings at the cross points. A voltage for drawing electrons from the electron emission devices into a vacuum is applied to the second wirings, and the second wiring has the role of a modulating electrode. Since each of the second wirings has an aperture for passing an electron beam emitted from the corresponding electron emission device, the second wiring can also control the electron beam emitted from the electron emission device to a desired shape. The electrodes having the phosphor are provided on the second substrate facing the first substrate, and a constant high voltage of 5,000 V–10,000 V can be applied. Hence, a high-acceleration phosphor can be used, and a bright high-definition image display device can be provided.

A method for manufacturing the first type of the image display device of the present invention preferably includes the following processes.

(1) A process of forming first wirings on a first substrate followed by applying a solution containing an organic metal on the first wirings, and then heating the applied solution in a desired atmophere to cause thermal decomposition (also called firing) and to form metal fine particles, or fine particles including carbon fine particles and metal fine particles on the first electrode.

(2) A process of forming carbon bodies by introducing a material including carbon onto the first substrate and decomposing the material by heat or the like.

(3) A process of forming a second electrode and a phosphor on a second substrate.

(4) A process of disposing, if necessary, spacers as an anti-atmospheric-pressure supporting members between the first substrate and the second substrate to form a vacuum container.

(5) A process of causing the inside of the vacuum receptacle to be an atmosphere including oxygen, and heating or generating a plasma to terminate oxygen on the surfaces of the carbon bodies.

(6) A process of introducing a low-work-function material into the vacuum container and coating the fine particles of the carbon bodies on the metal fine particles, serving as nuclei, with the low-work-function material.

(7) A process of heating the vacuum container while evacuating it.

(8) A process of sealing the vacuum container.

The processes of the manufacturing method of the present invention are not limited to the above-described ones. For example, the vacuum container may be formed after forming the electron emission devices. In this case, the manufacturing method may be executed in the sequence of processes (1), (2), (5), (6), (3), (4), (7) and (8). At that time, however, the processes (1), (2), (5) and (6) for forming the electron emission devices are executed by disposing the first substrate in a vacuum chamber or the like. Alternatively, the process (3) may be executed before the processes (1), (2), (5) and (6).

According to the method for manufacturing the image display device of the present invention, it is possible to manufacture an image display having a stable display quality and an excellent display quality. The method for manufacturing the image display device can be further simplified. For example, the processes (4) and (5) can be simultaneously executed. Hence, it is possible to manufacture an inexpensive display device having an excellent display quality. The second type of the image display device of the present invention can be manufactured according to a method similar to the method for manufacturing the first type of the image display device.

According to the electron emission device of the present invention, a plurality of fine particles of an electron emission body obtained by terminating carbon bodies formed on metal fine particles, serving as nuclei, with a low-work-function material via oxygen are partially disposed on an electrode on a substrate in a desired form, and an electrode where a voltage for drawing electrons from the emission body into a vacuum is applied is disposed. Hence, it is unnecessary to perform three-dimensional processing of sharpening the distal end of an electron emission body and ultra-fine submicron processing of a gate electrode. The work function is reduced. As a result, it is possible to provide an electron emission device which can emit electrons at a low electric field.

According to the method for manufacturing the electron emission device of the present invention, after applying a solution containing an organic metal on an electrode disposed on a substrate, the solution is heated to cause thermal decomposition in a desired atmosphere (also called firing), and to form metal fine particles, or fine particles including carbon fine particles and metal fine particles. Hence, it is possible to perform thermal decomposition of the solution containing the organic metal at a low temperature to form the metal fine particles, to control the density of the metal fine particles by the density of the metal component of the solution containing the organic metal, and to control the particle size of the metal fine particles by controlling the density of the metal of the solution containing the organic metal, the quantity of droplets, and the temperature of the thermal decomposition process. As a result, it is possible to form an electron emission device having an excellent controllability of the shape and the density as the electron emission body, and an excellent reproducibility.

According to the display device using the method for manufacturing the electron emission device of the present invention, the above-described problems in the prior art are solved, and it is possible to provide an electron emission device which can be driven at a low voltage and which has a high uniformity and an excellent mass production capability, and an image display device, such as a color flat panel or the like, having a excellent display quality which uses the electron emission devices.

Figure 1B:
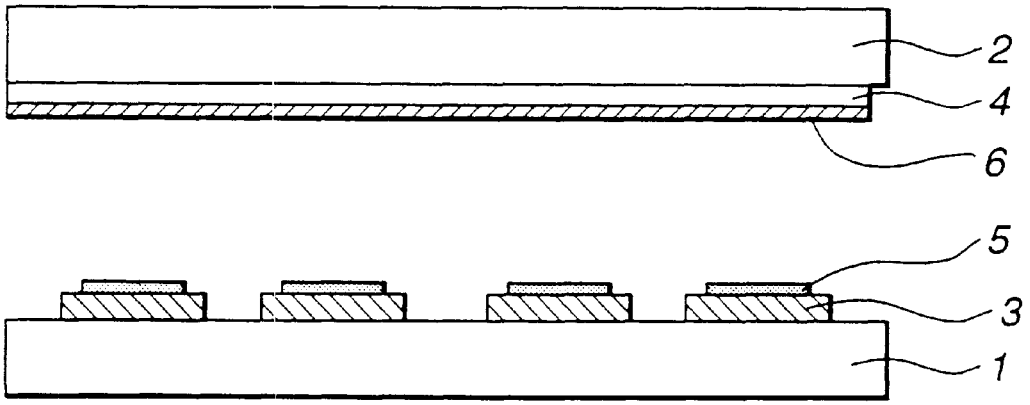
Figure 2A:
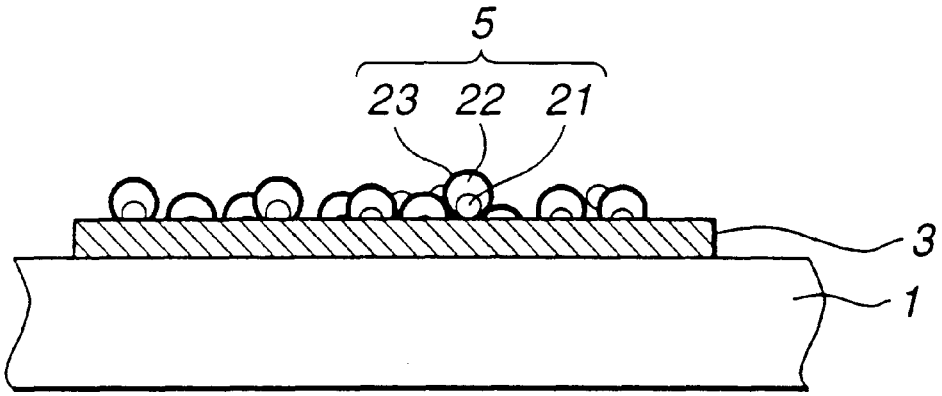
FIGS. 2(*a*) and 2(*b*) are partially enlarged views of one of the electron emission devices shown in FIGS. 1(*a*) and 1(*b*)
Figure 2B:
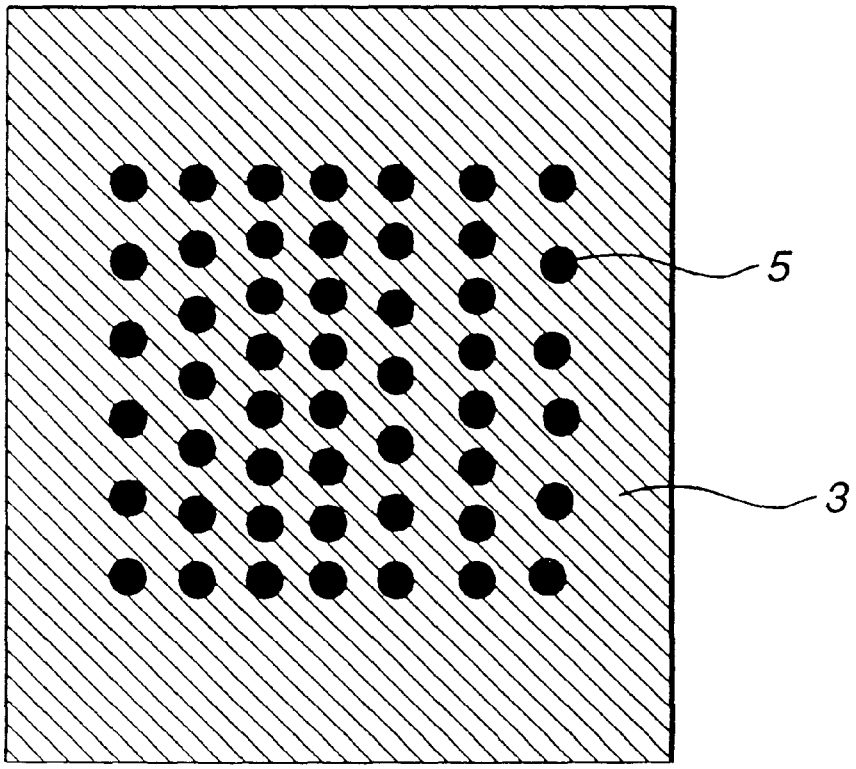

A preferred embodiment of the present invention will now be described in detail with reference to the drawings. FIGS. 1(*a*) and 1(*b*) are schematic diagrams illustrating a first preferred configuration of electron emission devices according to the present invention. FIGS. 2(*a*) and 2(*b*) are partially enlarged views of the electron emission devices shown in FIGS. 1(*a*) and 1(*b*).

FIG. 1(*a*) is a plan view illustrating the first configuration of the electron emission devices on a first substrate according to the present invention. FIG. 1(*b*) is a cross-sectional view of the electron emission devices shown in FIG. 1(*a*). In FIGS. 1(*a*) and 1(*b*), there are shown a first substrate 1, a second substrate 2, first electrodes 3, a second electrode 4, electron emission bodies 5, a phosphor 6 provided when using this configuration as an image display device.

Figure 12A:
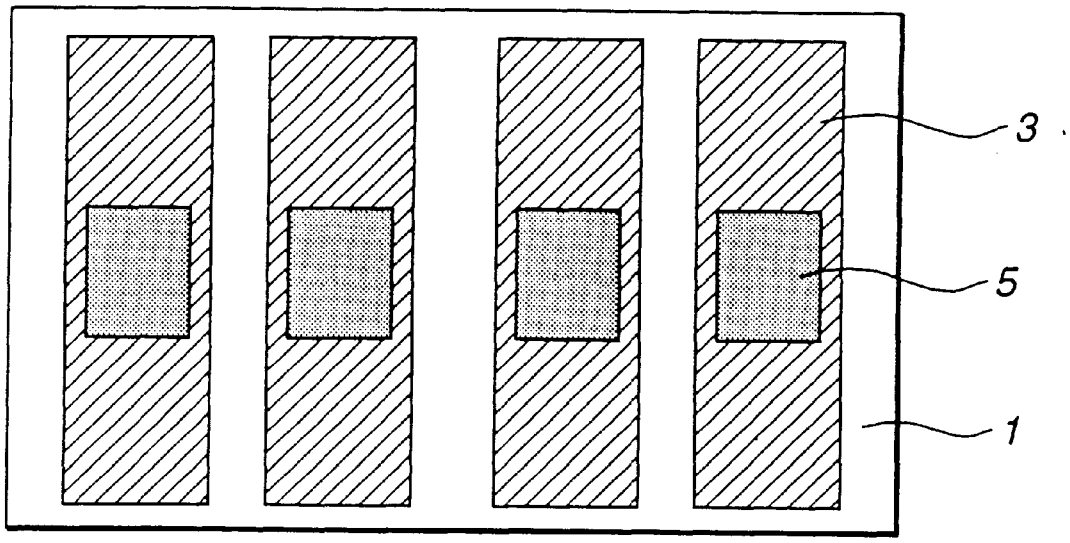
FIGS. 12(*a*) and 12(*b*) are schematic diagram illustrating a modification of the first configuration of electron emission devices shown in FIGS. 1(*a*) and 1(*b*).
Figure 12B:
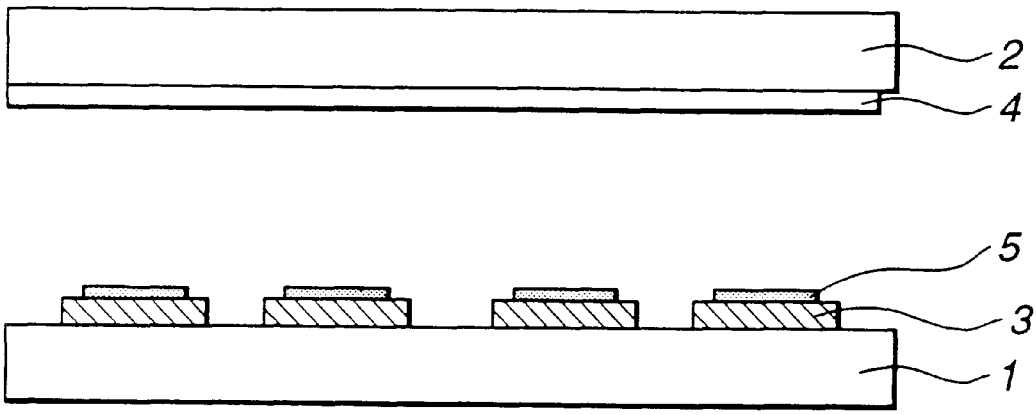

FIGS. 12(*a*) and 12(*b*) illustrate a case in which the phosphor 6 is not provided. In FIGS. 12(*a*) and 12(*b*), the same reference numerals as those shown in FIGS. 1(*a*) and 1(*b*) represent the same components.

FIGS. 2(*a*) and 2(*b*) are an enlarged cross-sectional view and an enlarged plan view, respectively, of a portion including the first substrate 1, the first electrode 3, and the electron emission body 5. In FIG. 2(*a*), the electron emission body 5 includes fine metal particles 21, carbon bodies 22, and a low-work-function material 23.

As shown in FIG. 2(*a*), the electron emission device of the first configuration has the feature that a plurality of the fine particles 21 of the electron emission body 5 are partially disposed on the electrode 3 on the substrate 1 in a desired form, and, as shown in FIG. 1(*b*), the electrode 4 where a voltage for drawing electrons from the electron emission body into a vacuum is applied is disposed. Furthermore, as shown in FIG. 2(*a*), the electron emission body 5 is formed by terminating the carbon bodies 22 formed on the metal fine particles 21, serving as nuclei, with the low-work-function material 23 via oxygen.

Figure 3:
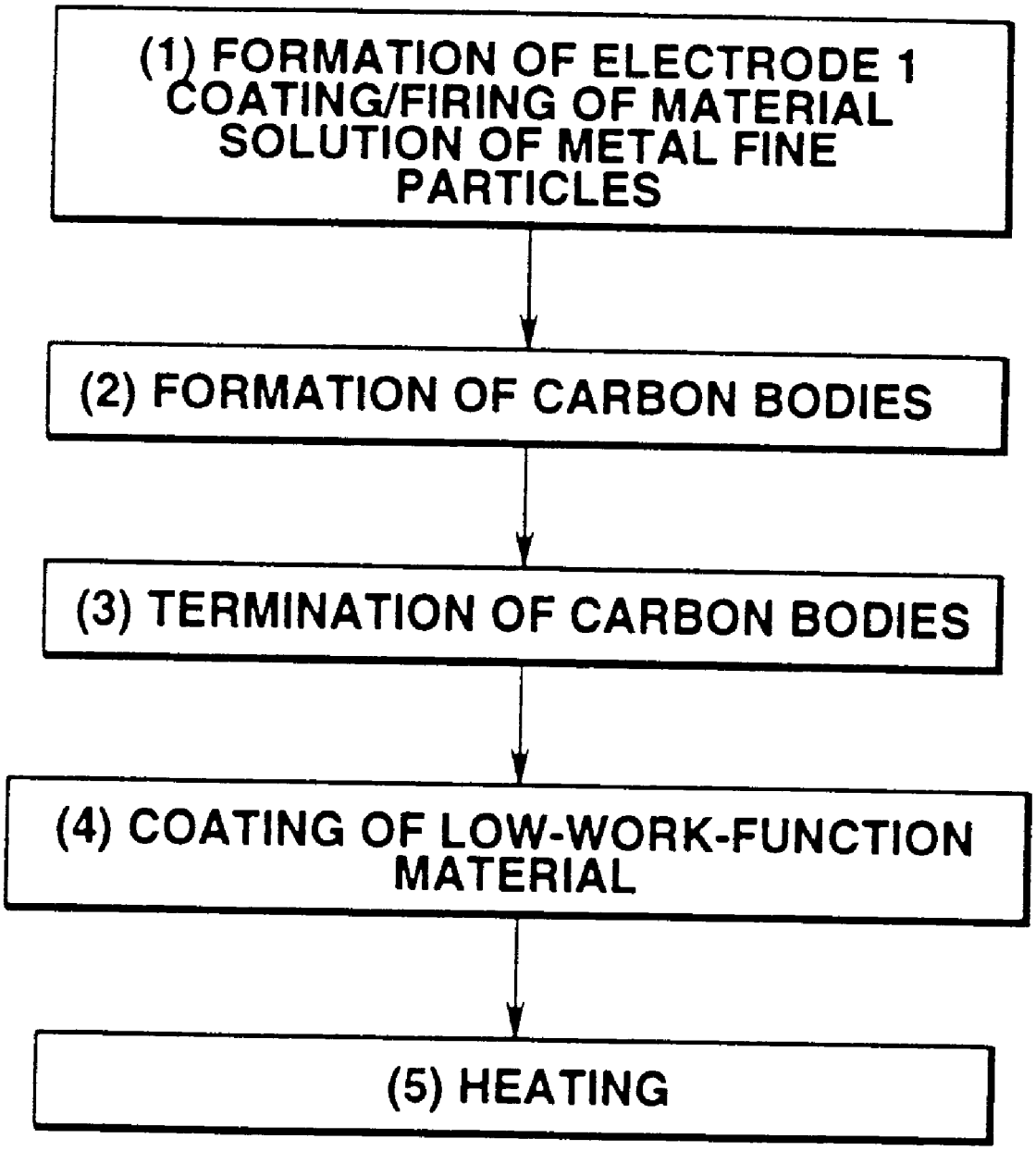
FIG. 3 is a flowchart illustrating a process for manufacturing the electron emission devices shown in FIGS. 1(*a*) through 2(*b*)

FIG. 3 is a flowchart illustrating an example of processes for manufacturing the electron emission devices of the present invention. A description will now be provided in the sequence of the following processes.

Process (1)

The substrate 1 is sufficiently cleaned using a detergent, an organic solvent, pure water and the like. After depositing a material for the electrodes 3 on the substrate 1 according to vacuum deposition, sputtering or the like, the electrodes 3 are formed on the substrate 1 according to photolithography. After providing a solution including an organic metal on the electrodes 3 according to an ink-jet method or the like, the solution is heated in a desired atmosphere to cause thermal decomposition (also called firing), and to form metal fine particles, or fine particles including carbon fine particles and metal fine particles.

Although the solution including the organic metal is provided onto the substrate 1 according to a spinner coating method or an ink-jet method, it is preferable that the solution is provided onto the substrate 1 in the form of solution droplets according to the ink-jet method. The ink-jet methods includes a piezo-jet method of discharging a solution with the energy of a piezoelectric element, a bubble-jet method of discharging a solution by providing it with thermal energy, and the like. The solution is provided in the form of a desired pattern. An aqueous solution of an organic complex of a metal is preferably used as the solution including the organic metal.

In a preferred method for manufacturing the electron emission devices of the present invention, the solution including the organic metal is provided onto a conductive thin film on the substrate 1 in the form of solution droplets. Particularly, the ink-jet method is preferably used from the viewpoint of efficiently and accurately controlling very small solution droplets. According to the ink-jet method, it is possible to reproducibly generate very small solution droplets having a weight from 10 nanograms to a few tens of nanograms and to provide the generated solution droplets onto the substrate 1. The ink-jet methods are grossly divided into two types, i.e., a bubble-jet method of discharging solution droplets from nozzles by heating the solution including the organic metal by heating resistors to generate bubbles, and a piezo-jet method of discharging solution droplets of the solution including the organic metal by the contraction pressure of piezoelectric elements disposed in the vicinity of nozzles.

Figure 4:
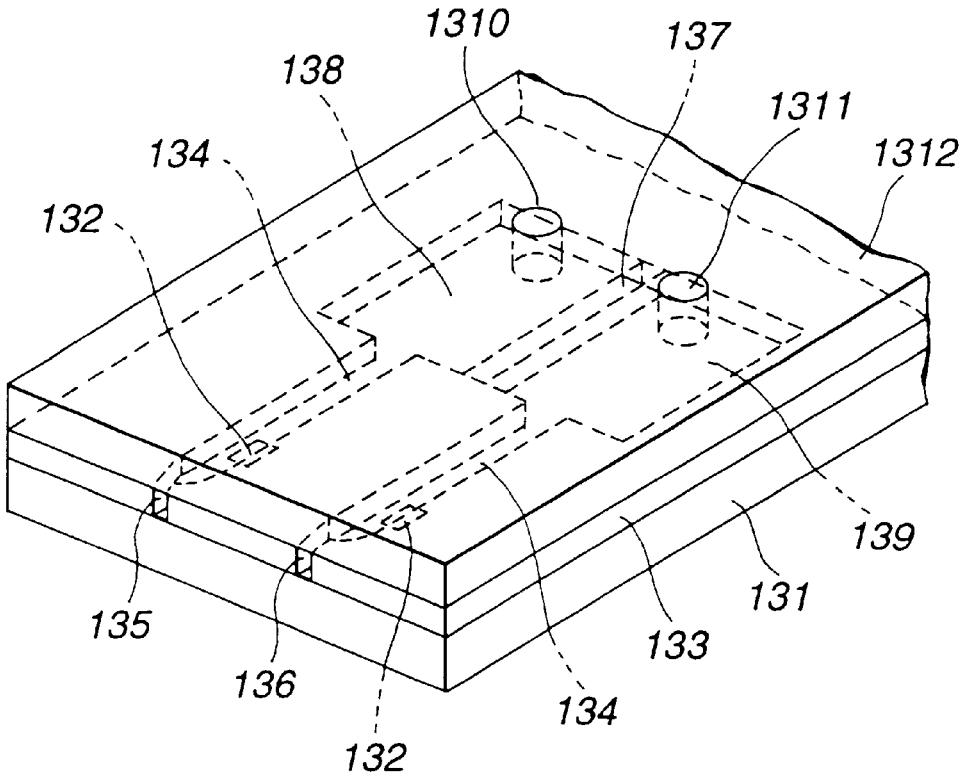
FIG. 4 is a diagram illustrating the configuration of an ink-jet-type header unit.
Figure 5:
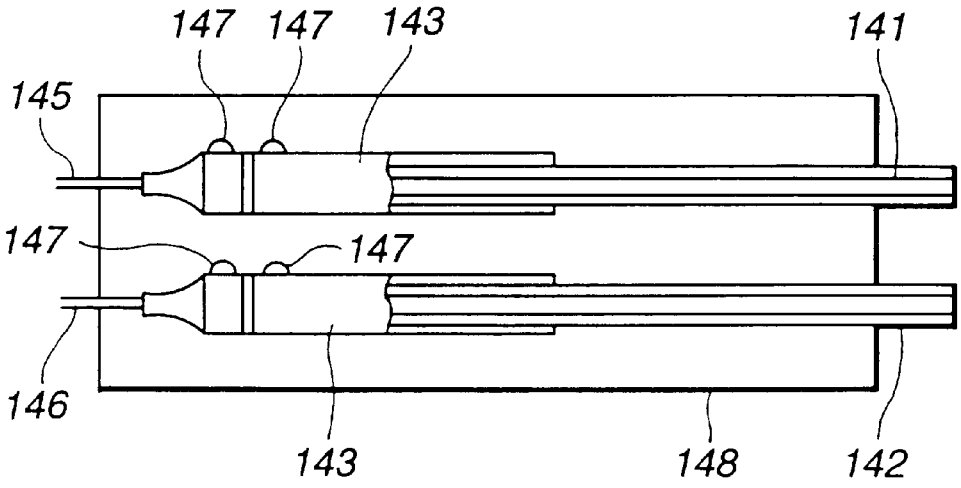
FIG. 5 is a diagram illustrating the configuration of another ink-jet-type header unit.

FIGS. 4 and 5 illustrate examples of devices according to ink-jet methods used in the present invention. FIG. 4 illustrates a device according to the bubble-jet method. In FIG. 4, there are shown a substrate 131, heat generating units 132, a supporting plate 133, solution channels 134, a first nozzle 135, a second nozzle 136, a partition 137 between ink channels, solution chambers 138 and 139 containing the solution of the organic metal, solution supply ports 1310 and 1311 containing the solution of the organic metal, and a top plate 1312. The organic-metal solution is discharged onto the first substrate 1 disposed so as to face the first nozzle 135 and the second nozzle 136.

FIG. 5 illustrates a device according to the piezo-jet method. In FIG. 5, there are shown a first glass nozzle 141, a second glass nozzle 142, cylindrical piezoelectic elements 143, organic-metal-liquid supply tubes 145 and 146, input terminals 147 for supplying the cylindrical piezoelectric elements 143 with an electrical signal, and a fixed substrate 148. The organic-metal solution is discharged from the filters 144 onto the facing first substrate 1. Although in FIGS. 4 and 5, two nozzles are shown, the number of nozzles is not limited to this value.

The density of the metal fine particles, which are a feature of the present invention, is controlled by the concentration of the metal component of the solution including the organic metal, and the particle size of the metal fine particles is controlled by the concentration of the metal of the solution including the organic metal, the quantity of solution droplets, the temperature and the atmosphere of the thermal decomposition process, and the like.

The atmosphere of the thermal decomposition process indicates an oxygen containing atmosphere in the air or the like, or a hydrogen containing atmosphere. When decomposing an easily oxidable metal material as an organic metal material in an oxygen containing atmosphere, a metal oxide is, in some cases, formed. In such a case, the obtained metal oxide is reduced to the metal by heating the oxide in a vacuum or in a hydrogen atmosphere.

Process (2)

Figure 6:
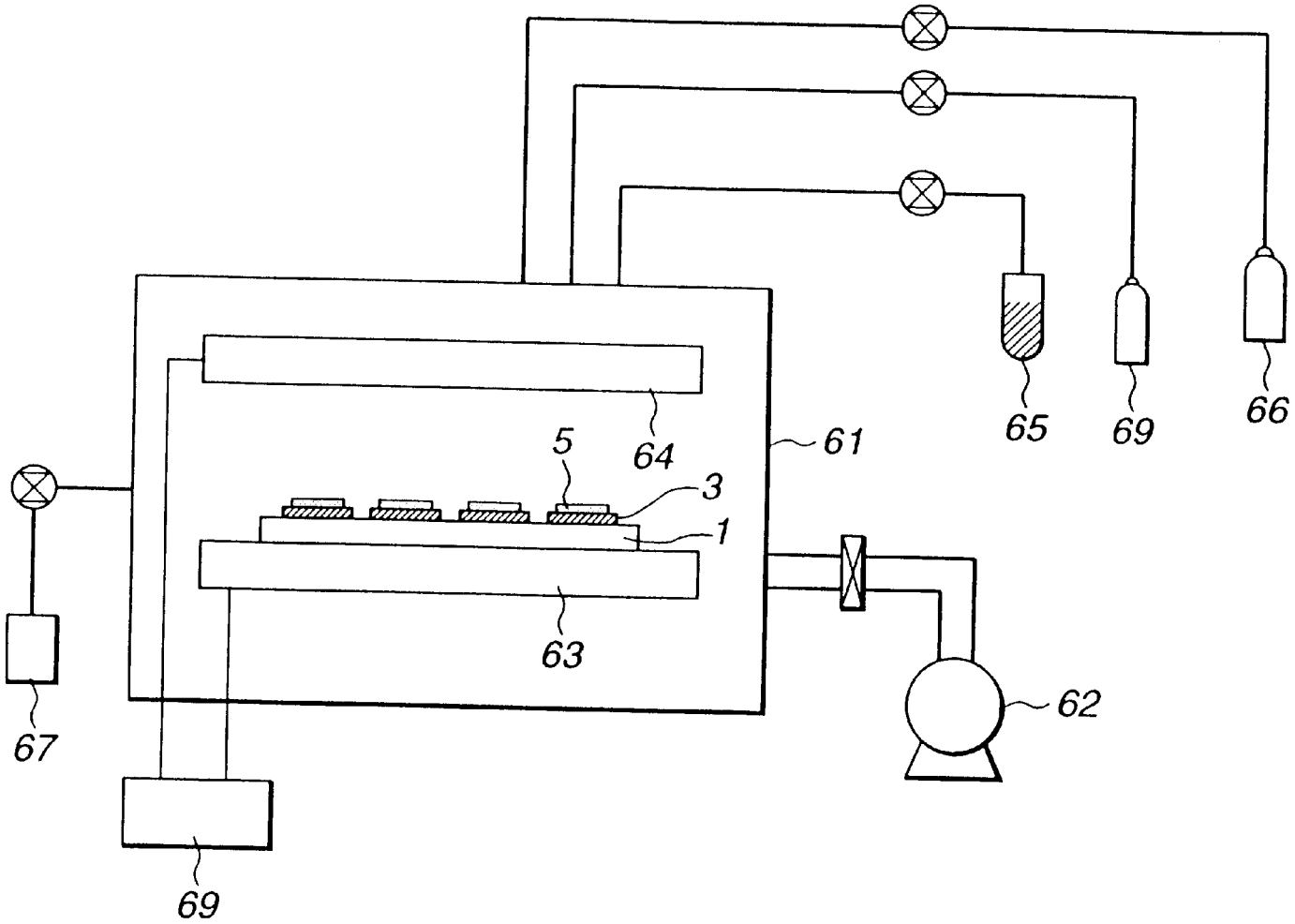
FIG. 6 is a diagram illustrating the configuration of a vacuum processing apparatus used for manufacturing the electron emission devices according to the present invention.

The substrate 1 is disposed in a vacuum processing apparatus shown in FIG. 6. In FIG. 6, the same components as those shown in FIG. 1 are indicated by the same reference numerals. That is, there are shown the first substrate 1, the first electrodes 3, and the electron emission bodies 5. There are also shown a vacuum container 61, an exhaust pump 62, electrodes 63 and 64 for generating a plasma, material sources 65 and 69 including carbon, an oxygen bomb 66, a source 67 for generating a low-work-function material, and a power supply 68 for generating a plasma. Materials for providing an electron emission device are disposed within the vacuum container 61.

An apparatus (not shown) necessary for performing measurement in a vacuum atmosphere, such as a vacuum gauge or the like, is provided within the vacuum container 61, so that measurement and evaluation can also be performed in a desired vacuum atmosphere. Alternatively, a vacuum chamber for measurement shown in FIG. 10 (to be described later) may be connected according to a load locking method, and, after forming electron emission devices using the vacuum processing apparatus shown in FIG. 6, measurement may be performed by moving the electron emission devices to the vacuum chamber for mesurement shown in FIG. 10.

The exhaust pump 62 includes an ordinary high-vacuum apparatus system including a turbopump and a rotary pump, and an ulra-high-vacuum apparatus system including an ion pump and the like. The material sources 65 and 69 including carbon comprise a gas bomb 69 in the case of a gas, and an ampoule 65 including a liquid in the case of a liquid. The material gas is introduced into the vacuum container 61. The entirety of the vacuum processing apparatus in which the electron emission devices are disposed can be heated by a heater (not shown) up to 300° C. The substrate 1 can be heated up to 800° C. After sufficiently evacuating the inside of the vacuum processing apparatus, the material including carbon is introduced into the apparatus. The entirety of the vacuum processing apparatus and the substrate 1 are heated by the heaters, and the gas of the organic material introduced from the material source 65 or 69 including carbon contacts the catalytic metal fine particles to be subjected to thermal decomposition. As a result, carbon bodies are selectively grown on the metal fine particles, serving as nuclei, formed in process (1).

The heating of the vacuum processing apparatus is performed at a temperature within a range so to suppress adsorption of the organic-material gas introduced from the material source 65 or 69 including carbon on the wall of the vacuum processing apparatus. Accordingly, it is preferable that the heating temperature of the vacuum processing apparatus is lower than the heating temperature of the substrate 1. Then, the vacuum container 61 is evacuated to a vacuum. The heating temperatures are appropriately selected and set depending on the fine-particle metal material, the introduced gas and the like.

Process (3)

An appropriate amount of oxygen is introduced into the vacuum container 61 from the oxygen bomb 66, the substrate 1 is then heated in an atmosphere including oxygen, and a plasma is generated between the electrodes 63 and 64 for generating a plasma, or between the electrode 63 for generating a plasma and the first electrodes 3 of the substrate 1 to terminate oxygen on the surfaces of the carbon bodies. Then, the vacuum container 61 is evacuated to a vacuum.

This process may also be achieved by causing the inside of the vacuum chamber 61 to be an atmosphere including oxygen and heating the substrate 1 without generating a plasma.

Process (4)

A low-work-function material is introduced onto the substrate 1 from the low-work-function material source 67, and the fine particles of the carbon bodies on the metal fine particles, serving as nuclei, are coated with the low-work-function material. At that time, the low-work-function material is coated to a thickness of at least a few atomic layers.

Process (5)

By evaporating a portion unbonded with oxygen on the surfaces of the carbon bodies in the low-work-function material which coats the fine particles of the carbon bodies by heating the substrate 1, the coated layer of the low-work-function material is made to be a monoatomic layer or a layer equal to or less than a few atomic layers.

FIGS. 11(*a*) and 11(*b*) are schematic diagrams illustrating a second configuration of electron emission devices according to the present invention: FIG. 11(*a*) is a plan view of the electron emission device on a first substrate; and FIG. 11(*b*) is a cross-sectional view of the electron emission devices.

In FIGS. 11(*a*) and 11(*b*), there are shown a first substrate 1, a second substrate 2, first electrodes 3, a second electrode 4, electron emission bodies 5, a phosphor 6 provided when the electron emission devices are used in a display device, a third electrode 7, and a supporting member 8 for electrically insulating the second electrode from the first electrode.

The feature of the electron emission devices of the second configuration is the same as that of the electron emission devices of the first configuration shown in FIGS. 1(*a*) and 1(*b*).

The processes for manufacturing the electron emission devices of the second configuration is the same as these of the electron emission devices of the first configuration shown in FIG. 3 except process (1). A description will now be provided of only process (1).

Process (1)

The substrate 1 is sufficiently cleaned using a detergent, an organic solvent, pure water and the like. After depositing a material for the electrodes 3 on the substrate 1 according to vacuum deposition, sputtering or the like, the electrodes 3 are formed on the substrate 1 according to photolithography. The insulating layer 8, made of $SiO_2$ or the like, and the electrode 7 are formed on the electrode 3 in a similar manner. After providing a solution containing an organic metal on the electrodes 3 according to an ink-jet method or the like, the solution is heated in a desired atmosphere to cause thermal decomposition (also called firing), and to form metal fine particles, or fine particles including carbon fine particles and metal fine particles. In the above-described manufacturing process, the insulating layer 8, made of $SiO_2$ or the like, and the electrode 4 may be formed after forming electron emission bodies.

Figure 7A:
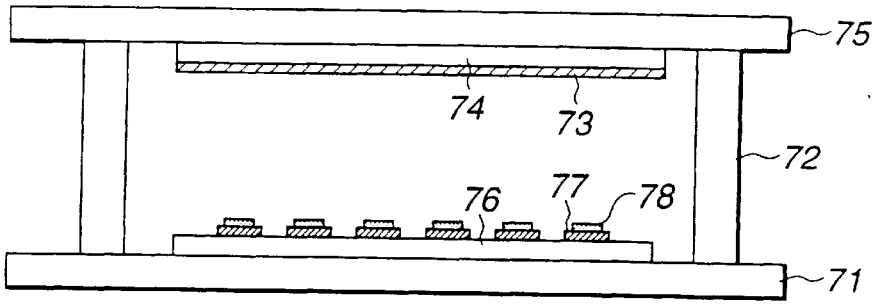
FIG. 7(*a*) is a cross-sectional view illustrating an image display device according to the present invention.
Figure 7B:
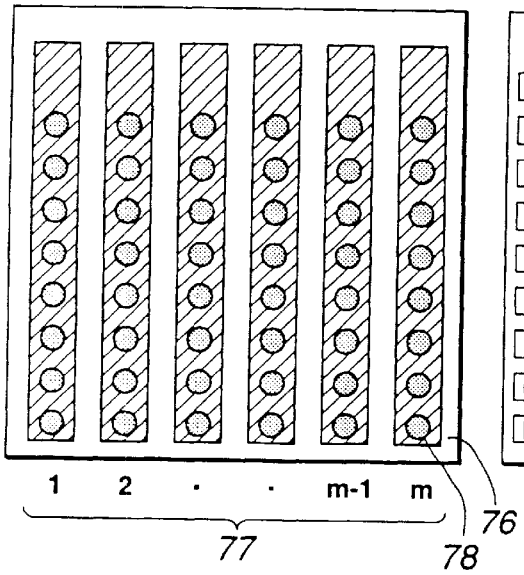
Figure 7C:
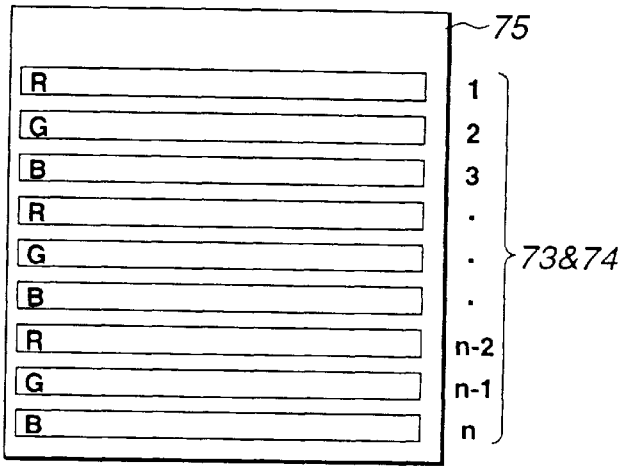

The above-described first configuration of the image display device will now be described with respect to FIGS. 7(*a*) through 7(*c*). FIG. 7(*a*) is a cross-sectional view of the image display device; FIG. 7(*b*) is a plan view illustrating a rear plate provided at a lower portion of the image display device; and FIG. 7(*c*) is a plan view illustrating a face plate provided at an upper portion of the image display device. In FIGS. 7(*a*) through 7(*c*), there are shown a rear plate 71, a supporting frame 72 for supporting a face plate 75, serving as a second substrate, and the rear plate 71, phosphors 73 in the form of red, green and blue stripes, transparent electrodes 74, serving as second wirings, made of ITO (indium-tin oxide) or the like, the face plate 75 provided at the image display side, a first substrate 76, first wirings 77, and electron emission bodies 78. Although the rear plate 71 and the first substrate 76 are provided as separate members, the first substrate 76 may also be used as the rear plate 71.

The image display device includes the first wirings 77 disposed on the first substrate 76, and the second wirings 74, having the phosphors 73, disposed on the second substrate 75 facing the first substrate 76. The m first wirings 77 and the n second wirings 74 are substantially orthogonal to each other. A plurality of the electron emission bodies 78 are formed on the first wirings 77 at m×n cross points of the first wirings 77 and the second wirings 74. Thus, the image display device is provided.

The first wirings 77 are selectively scanned in accordance with an image signal, and at the same time, a modulating signal is input to the second wiring 74. Electrons corresponding to the image signal are emitted from the electron emission device having a plurality of the electron emission bodies 78 at each cross point, and the accelerated electrons impinge onto the phosphor 73 of each pixel to emit light and thereby to display an image.

Figure 8A:
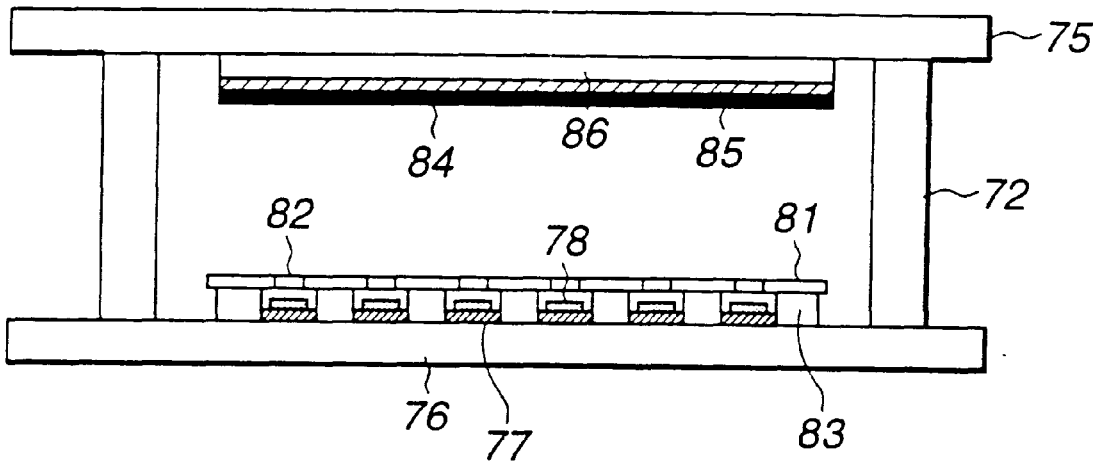
FIG. 8(*a*) is a cross-sectional view illustrating another image display device according to the present invention.
Figure 8B:
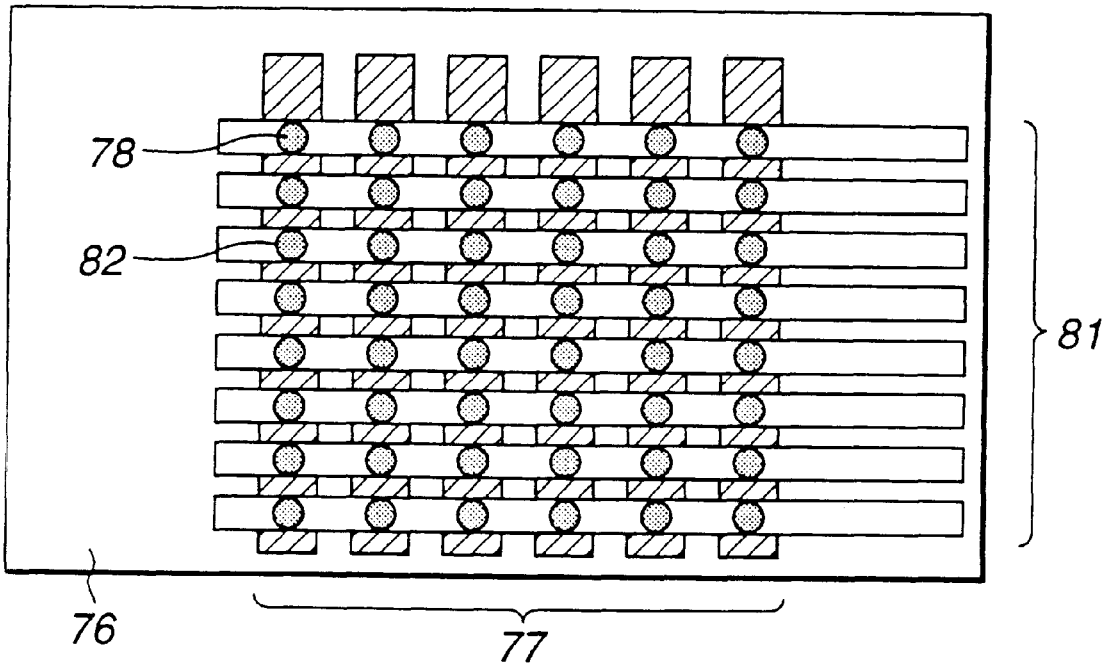

The image display device of the present invention may also have the following configuration. The second configuration of the image display device of the present invention will now be described with reference to FIGS. 8(*a*) and 8(*b*). FIG. 8(*a*) is a cross-sectional view of the second comfiguration of the image display device of the present invention; and FIG. 8(*b*) is a plan view illustrating a rear plate provided at a lower portion of the image display device.

In FIGS. 8(*a*) and 8(*b*), there are shown a supporting frame 72 for supporting a face plate 75 and a rear plate 76, phosphors 85, transparent electrodes 86 made of ITO or the like, the face plate 75, a first substrate 76 also serving as the rear plate, first wirings 77, electron emission bodies 78, second wirings 81 having apertures 82, the apertures 82 for passing electron beams generated from the electron emission bodies 78, a supporting member 83, comprising an insulating layer made of $SiO_2$ or the like, for electrically insulating the first wirings 77 and the second wirings 81 from each other.

The m first wirings 77 disposed on the first substrate 76 and the n second wirings 81, having the apertures 82, disposed on the first substrate 76 via the insulating layer 83 are substantially orthogonal to each other. A plurality of the electron emission bodies 78 are formed on the first wirings 77 at m×n cross points of the first wirings 77 and the second wirings 81. The transparent electrodes 86, the phosphors 85 and a metal back 84 are disposed on the face plate 75. Thus, the image display device is provided.

The phosphors 85 comprise red, green and blue phosphors coated in the form of a stripe. The transparent electrode 86 serves as a common electrode for each of the red, green and blue phosphors. Black stripes are formed between red, green and blue phosphors.

The first wirings 77 are selectively scanned in accordance with an image signal, and at the same time, a modulating signal is input to the second wiring 81. Electrons corresponding to the image signal are emitted from the electron emission device having a plurality of the electron emission bodies 78 at each cross section, and an electron beam accelerated by a voltage applied to the transparent electrodes 86 and the metal back 84 impinges onto the phosphor 85 of each pixel corresponding to one of the apertures 82 of the second wirings 81 to emit light and thereby to display an image to an observer present above.

Figure 9:
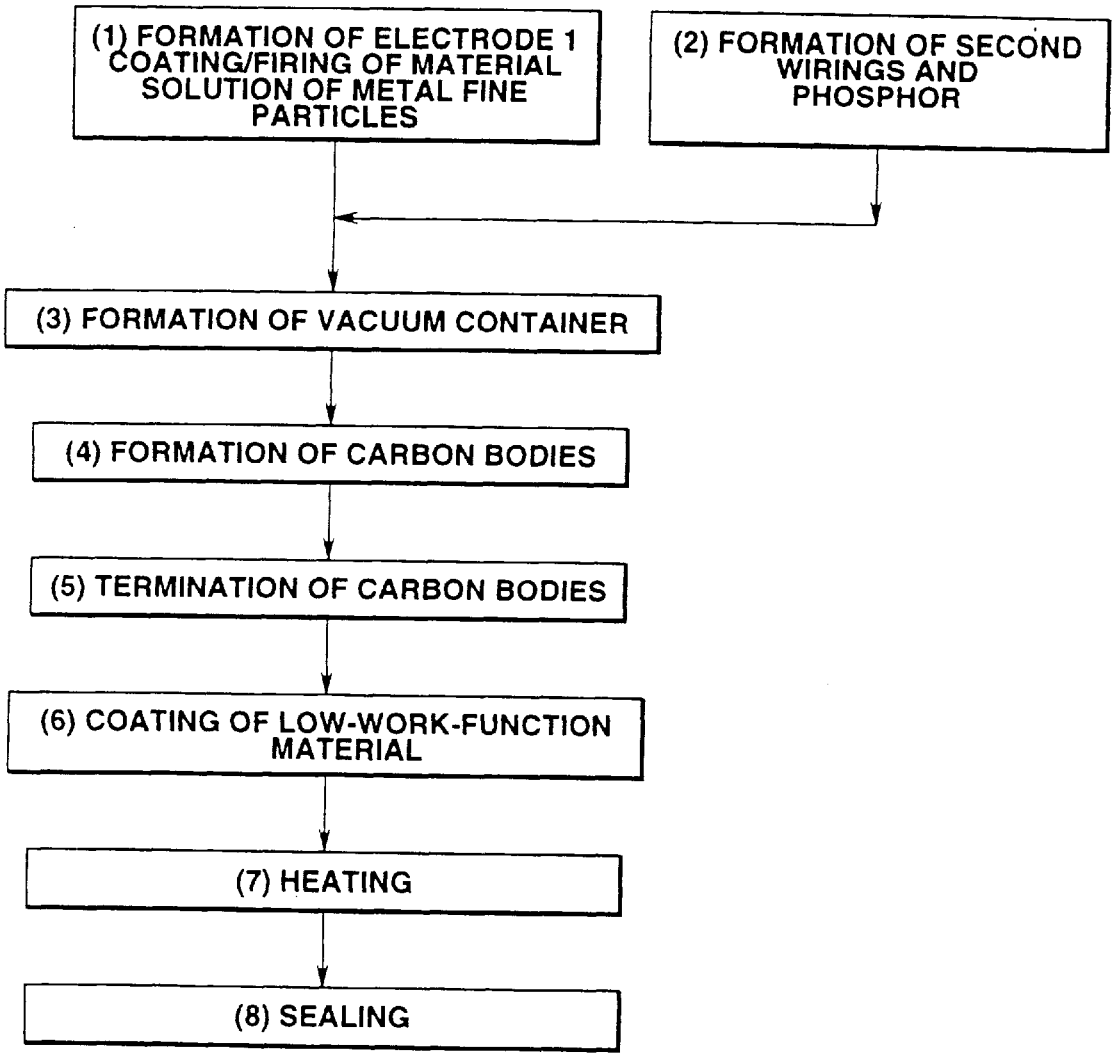
FIG. 9 is a flowchart illustrating a process for manufacturing electron emission devices of the display device shown in FIGS. 7(*a*) through 7(*c*)

A method for manufacturing the first configuration of the image display device of the present invention shown in FIGS. 7(*a*) through 7(*c*) includes processes indicated in the flowchart shown in FIG. 9. A description will now be provided of the respective processes.

Process (1)

The first wirings 77 are formed on the first substrate 76 followed by applying a solution containing an organic metal on the first wirings 77, and then the applied solution is heated in a desired atmophere to cause thermal decomposition (also called firing), and to form metal fine particles, or fine particles including carbon fine particles and metal fine particles.

Process (2)

The second wirings 74 and the phosphors 73 are formed on the second substrate 75.

Process (3)

The supporting frame 72 for supporting the rear plate 71 having the first substrate 76 disposed thereon, and the face plate serving as the second substrate 75, and if necessary, a spacer as an anti-atmospheric-pressure supporting member between the first substrate 76 and the second substrate 75 are disposed to form a vacuum container by the rear plate 71 and the face plate 75.

Process (4)

Fine particles of carbon bodies on the metal fine particles, serving as nuclei, are formed by introducing a material including carbon onto the first substrate 76 and decomposing the material by heat or the like.

Process (5)

The inside of the vacuum container is caused to be an atmosphere including oxygen, and oxygen is terminated on the surfaces of the carbon bodies by heating or generating a palsma.

Process (6)

A low-work-function material is introduced into the vacuum container and the fine particles of the carbon bodies on the metal fine particles, serving as nuclei, are coated with the low-work-function material.

Process (7)

The vacuum container is heated while evacuating it.

Process (8)

The vacuum container is sealed.

The processes of the manufacturing method of the present invention are not limited to the above-described ones. For example, the vacuum container may be formed after forming the electron emission devices. In this case, the manufacturing method may be executed in the sequence of processes (1), (4), (5), (6), (7), (2), (3) and (8).

The electron emission devices of the present invention can be applied not only to electron sources or an image display device used in a television or a computer, but also to vacuum tubes for microelectronics, a printer or the like. However, the range of application of the electron emission devices of the present invention is not limited to the above-described one.

EXAMPLE 1

FIGS. 1(*a*) and 1(*b*) are a plan view and a cross-sectional view, respectively, of the electon emission devices of the present invention. In FIGS. 1(*a*) and 1(*b*), there are shown the first substrate 1, the second substrate 2, the first electrodes 3, the second electrode 4, the electron emission bodies 5, and the phosphor 6. Four devices having the same shape are formed on the first substrate 1.

A method for manufacturing the electron emission devices will now be sequentially described with reference to FIGS. 1(*a*) and 1(*b*).

(Step 1)

By depositing Mo to a thickness of 1,000 nm on the first substrate 1, made of cleaned quartz glass, according to a sputtering method, the parallel four first electrodes 3 were formed. Then, after providing solution droplets of an aqueous solution of nickel formate onto the first electrodes 3 in the form of the electron emission bodies 5, the solution droplets were subjected to thermal decomposition at 350° C. in the air. Another six samples of the first substrate 1 were provide according to the same operation. The substance obtained by performing thermal decomposition of the solution droplets provided by the ink-jet method had substantially the shape of a circle having a diameter of 110 $\mu$m.

(Step 2)

Each sample of the first substrate 1 provided in step 1 was disposed in the vacuum processing apparatus shown in FIG. 6. After sufficiently evacuating the inside of the apparatus, the substrate 1 was heated at 150° C. while removing water and the like by evacuating the inside of the apparatus. Then, the first substrate 1 was heated at 350° C. in hydrogen in order to reduce fine particles of nickel oxide to provide fine particles of nickel metal. Then, methane was introduced into the vacuum chamber while maintaining the pressure at 10 Torr. Then, one of the first substrates 1 was maintained at 400° C. for one hour. One sample, another two samples and still another one sample from among the remaining five samples of the first substrate 1 were maintained at 500° C., 600° C. and 700° C., respectively, for one hour by the same operation.

(Step 3)

Then, the five samples of the first substrate 1 were subjected to plasma processing for 5 minutes by generating a plasma in an atmosphere including 100 mTorr of oxygen.

(Step 4)

Cs serving as a low-work-function material was deposited on four samples of the first substrate 1 in a vacuum. Cs was not coated on one of the two samples processed at 600° C. in step 2. Cs was generated by disposing in advance cesium nitride in the low-work-function-material generating source 67 and heating the cesium nitride.

(Step 5)

Then, the six samples were heated at 250° C. for 1 hour.

The six samples of the first substrate 1, i.e., the sample subjected to step 1 and only the reduction process of step 2, the samples processed at 400° C., 500° C., 600° C. and 700° C. in step 2, the sample processed at 600° C. in step 2 and exempted from the process of step 4, and the sample processed at 600° C. in step 2 and exempted from the process of step 3 will be named samples 1-A, 1-B, 1-C, 1-D, 1-E, 1-F and 1-G, respectively.

Then, after depositing a material for the transparent electrodes 4 in a vacuum, five parallel transparent electrodes 4 were formed by patterning in the same manner as in the above-described step 1. Then, after applying the phosphor 6 according to a known slurry method, the same patterning as in the transparent electrodes 4 was performed.

Figure 10:
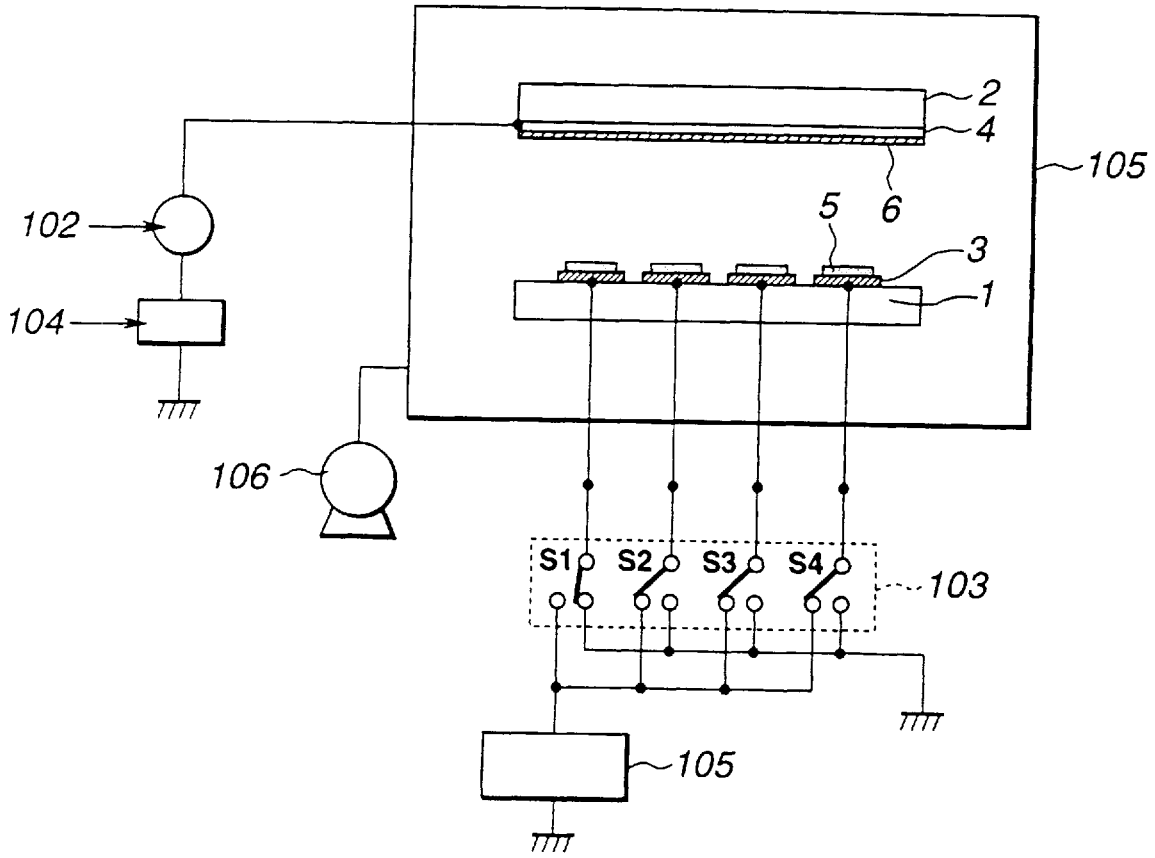
FIG. 10 is a diagram illustrating the configuration of an apparatus for measuring electon emission devices according to the present invention.

The first substrate 1 and the second substrate 2 formed in the above-described manner were disposed in a measuring apparatus including a vacuum chamber, a pump and the like. FIG. 10 illustrates the apparatus for measuring the electron emission devices of the present invention. In FIG. 10, the same components as those shown in FIG. 1 are indicated by the same reference numerals. That is, there are shown the first substrate 1, the second substrate 2, the first electrodes 3, the second electrodes 4 comprising the transparent electrodes, the electron emission bodies 5, and the phosphor 6. A voltage source 104 can apply an arbitrary voltage from 0 V to 10,000 V in order to measure the characteristics of the electron emission devices. An ammeter 104 measures emission current Ie emitted from the electron emission device on the first substrate 1. There are also shown a scanning circuit 103, a voltage source 101 for selecting one of electron emission devices, a vacuum container 105, and an exhaust pump 106. The electron emission devices are disposed within the vacuum container 105.

An apparatus (not shown) necessary for performing measurement in a vacuum atmosphere, such as a vacuum gauge or the like, is provided within the vacuum container 105, so that measurement and evaluation can be performed in a desired vacuum atmosphere. The exhaust pump 106 includes an ordinary high-vacuum apparatus system including a turbopump and a rotary pump, and an ulra-high-vacuum apparatus system including an ion pump and the like. The entirety of the vacuum processing apparatus in which the electron emission devices are disposed can be heated by a heater (not shown) up to 300° C. The substrate 1 can be heated up to 800° C.

The first electrodes 3 on the first substrate 1 are connected to the scanning circuit 103. The scanning circuit 103 incorporates 4 switching elements, as schematically represented by S1 through S4. Each of the switching elements selects one of the output voltage of the voltage source 101 and 0 V (the ground level), and a voltage for drawing and accelerating electrons is applied between the first electrode 3 on the first substrate 1 of the selected electron emission device and the transparent electrode 4 from the voltage source 104.

Each of the samples 1-A, 1-B, 1-C, 1-D, 1-E, 1-F and 1-G of the first substrate 1 was disposed within the vacuum container with a distance between the first substrate 1 and the second substrate 2 of 250 $\mu$m, and the inside of the vacuum container was evacuated. The value of emission current Ie as a mean value of four emission currents and the voltage dependency of the emission current Ie were measured when 500 V was applied to the electron emission device.

Table 1 shows the results of the measurement.

TABLE 1

| | Mean value of four emission currents at 500 V | Voltage dependency of emission current |
|---|---|---|
| 1-A | Lower than detection limit | — |
| 1-B | Very small current | — |
| 1-C | 100 $\mu$A | Abrupt increase with voltage |
| 1-D | 105 $\mu$A | Abrupt increase with voltage |
| 1-E | 103 $\mu$A | Abrupt increase with voltage |
| 1-F | Lower than detection limit | — |
| 1-G | Very small current | |

As shown in Table 1, the emission current was lower than the detection limit or very small for samples 1-A, 1-B, 1-F and 1-G. On the other hand, a stable large emission current was observed for each of the samlples 1-C, 1-D and 1-E. In these samples, the emission current abruptly increases with the voltage applied to the second electrode 4 on the second substrate 2, and is substantially linear in Fowler-Nordheim plotting (plotting $Ie/V^2$ with respect to 1/V, where Ie is the emission current, and V is the applied voltage). It can be understood that the concerned electron emission element is a field emission element from this linear FN (Fowler-Nordheim) characteristic. The value of the emission current shown in Table 1 is a value when the voltage applied to the second electrode 4 is 500 V. Since the distance between the first substrate 1 and the second substrate 2 was made to be 250 $\mu$m, the applied electric field was $2\times10^4$ V/cm, so that an emission current was detected at a low electric field. Although a mean value of four elements was used for the emission current shown in Table 1, variations were very small.

Then, the samples 1-A, 1-B, 1-C, 1-D, 1-E, 1-F and 1-G were taken out and observed under an electron microscope, by electron spectroscopy for chemical analysis (ESCA), and the like.

In the sample 1-A, Ni fine particles having an average particle size of 5 nm were dispersed on the Mo electrodes, little amount of carbon and Cs was detected. In the samples 1-B and 1-G, small amounts of carbon and Cs were detected on Ni fine particles. In the samples 1-C, 1-D, 1-E and 1-F, Ni fine particles were coated with carbon, and in the samples 1-C, 1-D and 1-E, it seemed that Ni fine particles were also coated with Cs. In the sample 1-E, Cs was partly observed also on the Mo electrodes. When the sample 1-F was observed under a TEM (transparent electron microscope), graphite was formed on metal fine particles. Carbon was not formed on the Mo electrodes in all of the samples. The density of Ni fine particles was $2\times10^{11}$ particles/cm$^2$. The number per unit area was counted in an image obtained by the electron microscope.

The following items can be estimated from the foregoing results.

(1) By changing the temperature for forming carbon between 400° C. and 700° C. in the structure of Ni/C (carbon)/Cs, it can be understood that the device is stable at temperatures equal to or higher than 500–600° C.

(2) Electron emission at a low electric field does not occur in the device only having Ni fine particles (from the result of measurement and observation for the sample 1-A).

(3) Electron emission at a low electric field does not occur when Cs is absent even if carbon is present on Ni (from the result of measurement and observation for the sample 1-F).

(4) Electron emission at a low electric field does not occur when oxygen plasma processing is not performed even if carbon is present on Ni (from the result of measurement and observation for the sample 1-G).

(5) A temperature for forming stable carbon in an oxygen plasma is equal to or higher than 500–600° C. (from the result of measurement and observation for the samples 1-B, 1-C, 1-D and 1-E).

(6) Ni fine particles which form stable carbon bodies form stable surfaces of a low-work-function material with Cs. As a result, electron emission occurs even at a low electric field (from the result of measurement and observation for the samples 1-C, 1-D and 1-E).

(7) By forming Ni metal fine particles, the amount of electron emission can be reproducibly provided (from the result of measurement and observation for the samples 1-C, 1-D and 1-E).

(8) Carbon bodies are selectively formed on Ni metal fine particles, serving as nuclei, on the Mo electrodes.

EXAMPLE 2

In Example 2, Pd (palladium) was used as the metal of the metal fine particles, the heating temperature in step (5) of Example 1 was changed within a range of 100° C.–300° C., and the same measurement and observation as in Example 1 were performed.

(Step 1)

By depositing Mo to a thickness of 100 nm on the first substrate 1, made of cleaned quartz glass, according to a sputtering method, the parallel four first electrodes 3 were formed. Then, after providing liquid droplets of an aqueous solution of monoethanolamine palladium acetate onto the first electrodes 3 in the form of the electron emission bodies 5 according to an ink-jet method, the liquid droplets were subjected to thermal decomposition in the air at 350° C. Five samples of the first substrate 1 were provided by the same operation. The substance obtained by performing thermal decomposition of the liquid droplets provided by the ink-jet method had substantially the shape of a circle having a diameter of 115 μm.

(Step 2)

Each sample of the first substrates 1 provided in step 1 was disposed in a vacuum chamber. After sufficiently evacuating the inside of the vacuum chamber, the substrate 1 was heated at 150° C. while removing water and the like by evacuating the inside of the chamber. Then, the first substrate 1 was heated at 200° C. in a vacuum in order to perform reduction to provide metal palladium fine particles. Then, ethylene was introduced into the vacuum chamber while maintaining the pressure at 1 Torr. Then, one sample of the first substrate 1 was maintained at 600° C. for 20 minutes. The other samples of the first substrate 1 formed in step 1 were also processed by the same operation.

(Step 3)

Then, five samples of the first substrate 1 were subjected to plasma processing for 5 minutes by generating a plasma in an atmosphere including 100 mTorr of oxygen.

(Step 4)

Cs serving as a low-work-function material was deposited on each sample of the first substrate 1 in a vacuum. Cs was generated by disposing in advance cesium nitride in the low-work-function-material generating source 67 and heating the cesium nitride.

(Step 5)

Then, the five samples were heated at 100° C., 150° C., 200° C., 250° C. and 300° C. for 15 minutes. Electron emission devices formed in the above-described steps will be named 2-A, 2-B, 2-C, 2-D and 2-E, respectively.

Table 2 shows the results of measurement of these samples. A voltage of 500 V was applied between the first electrode 3 and the second electrode 4 of each of the devices, and the emission current Ie of the element, and the voltage dependency and the time dependency of the emission current Ie were observed for 30 minutes.

TABLE 2

| | Emission current at 500 V | Voltage dependency and time dependency of emission current |
|---|---|---|
| 2-A | 70 μA, large variations | Unstable with time |
| 2-B | 65 μA, large variations | Unstable with time |
| 2-C | 110 μA | Stable with time<br>Abrupt increase with voltage |
| 2-D | 107 μA | Stable with time<br>Abrupt increase with voltage |
| 2-E | 110 μA | Stable with time<br>Abrupt increase with voltage |

As shown in Table 2, in the samples 2-A and 2-B, the emission current changes with time and has large variations. On the other hand, in each the samples 2-C, 2-D and 2-E, a large emission current was stably and reproducibly observed. In addition, the emission current abruptly increases with the voltage applied to the second electrode on the second substrate, and is substantially linear in Fowler-Nordheim plotting.

Then, the samples 2-A, 2-B, 2-C, 2-D and 2-E were taken out and observed under an electron microscope and by micro ESCA and the like.

In the samples 2-A and 2-B, Pd fine particles covered with carbon were dispersed on the Ho electrodes and were further covered with Cs. In the samples 2-C, 2-D and 2-E, although Pd fine particles were covered with carbon and were further covered with Cs, the amount of Cs was smaller than in the samples 2-A and 2-B. The density of the fine particles was $6\times10^{11}$ particles/cm$^2$. The number per unit area was counted in an image obtained by the electron microscope.

The following items can be estimated from the foregoing results.

(1) By observing the samples within the range of the heat treatment temperature of 100° C.–300° C. in the structure of Pd/C/Cs, it can be understood that the element is stable at temperatures equal to or higher than 200° C.

(2) Pd fine particles having stable carbon formed thereon heated at a temperature equal to or higher than 200° C. form stable surfaces of a low-work-function material with Cs. As a result, such samples have little variations, little changes with time, and performs electron emission at a low electric field (from the result of measurement and observation for the samples 2-C, 2-D and 2-E).

(3) Pd fine particles having stable carbon formed thereon heated at a temperature equal to or lower than 200° C. cannot form stable surfaces of a low-work-function material with Cs because excessive Cs is present. As a result, such samples have large variations and large changes with time (from the result of measurement and observation for the samples 2-A and 2-B).

EXAMPLE 3

In Example 3, Pt (platinum) was used as the metal of the metal fine particles, the low-work-function material in step 4 in Example 1 was changed, other steps are the same as in Example 1, and measurement and observation were performed. Since steps 1, 2, 3 and 5 are the same as in Example 1, a description thereof will be omitted. Five samples of the first substrate 1 were provided. Pt in step 1 was formed from an aqueous solution of monoethanolamine platinum acetate. The forming temperature in step 2 was 600° C. In vacuum deposition in step 4, low-work-function materials Ca, Ba, Sr and Cs were deposited on four samples of the first substrate 1.

Table 3 shows the results of measurement of these samples. A voltage of 500 V was applied between the first electrode 3 and the second electrode 4 of each of the devices, and the emission current Ie of the device, and the voltage dependency of the emission current Ie were observed for 30 minutes.

TABLE 3

| Low-work-function material | Emission current at 500 V | Voltage dependency of emission current |
|---|---|---|
| Ca | 80 μA | Abrupt increase with time |
| Sr | 100 μA | Abrupt increase with time |
| Ba | 80 μA | Abrupt increase with time |
| Cs | 110 μA | Abrupt increase with time |

The following items can be estimated from the foregoing results.

(1) All of the samples are stable in the configuration of Pt/C/low-work-function material.

(2) In Pt fine particles having stable carbon formed thereon combined with anyone of the low-work-function materials, variations are little, and the emission current abruptly increases with the applied voltage. Hence, electron emission can be performed even at a low electric field, and the amount of display light can be controlled

EXAMPLE 4

In Example 4, a method for forming an electron emission device which controls the particle size and the density of metal fine particles is studied. The particle size and the density of metal fine particles are controlled by the kind of a material for an organic metal compound, the form of an organic compound bonded with a metal, the contents of an organic metal compound, the firing temperature, the firing rate (obtained by dividing the firing temperature by the time required to reach the temperature), and the like. In Example 4, the contents of an organic metal compound, the firing temperature and the firing rate were controlled.

In Example 4, Pt was used as the metal of the metal fine particles, only step (1) of Example 1 was performed by changing conditions for forming the metal fine particles, and the same measurement and observation as in Example 1 were performed.

(Step 1)

By depositing Mo to a thickness of 100 nm on the first substrate 1, made of cleaned quartz glass, according to a sputtering method, the parallel four first electrodes 3 were formed. Then, after providing liquid droplets of an aqueous solution of monoethanolamine platinum acetate onto the first electrodes 3 in the form of the electron emission bodies 5 according to an ink-jet method, the liquid droplets were subjected to thermal decomposition in the air. Five samples of the first substrate 1 were provide by the same operation. Electron emission devices formed in this step 1 will be named samples 4-A, 4-B, 4-C and 4-D.

In another sample, after providing liquid droplets of an aqueous solution of monoethanolamine platinum acetate onto the first electrodes 3 in the form of the electron emission bodies 5 according to an ink-jet method, the liquid droplets were subjected to thermal decomposition in the air. Then, the sample was heated at 350° C. in hydrogen to coagulate platinum fine particles and increase the particle size of the fine particles, and the density of the fine particles was controlled. This sample will be named sample 4-E.

All of the substances obtained by performing thermal decomposition of the liquid droplets provided by the ink-jet method had substantially the shape of a circle having a diameter of 110 μm.

Table 4 shows forming conditiions, i.e., the contents of the organic metal compound (the weight % of the metal component), the firing temperature (° C.) and the firing rate (° C./min), of each sample, and the results of observation of each sample, i.e., the particle size (nm) and the density (particles/cm$^2$) of metal fine particles.

TABLE 4

| | Contents of organic metal compound (weight % of metal component) | Firing temperature (° C.) | Firing rate (° C./min) | Particle size (nm) and density (particles/cm$^2$) of metal fine particles |
|---|---|---|---|---|
| 4-A | 0.05% | 300° C. | 5° C./min | 5 nm<br>$4\times10^{10}$ |
| 4-B | 0.05% | 400° C. | 5° C./min | 9 nm<br>$1\times10^{11}$ |

TABLE 4-continued

| | Contents of organic metal compound (weight % of metal component) | Firing temperature (° C.) | Firing rate (° C./min) | Particle size (nm) and density (particles/cm$^2$) of metal fine particles |
|---|---|---|---|---|
| 4-C | 0.1% | 400° C. | 5° C./min | 10 nm $2.5 \times 10^{11}$ |
| 4-D | 0.1% | 400° C. | 10° C./min | 7 nm $5 \times 10^{11}$ |
| 4-E | 0.1% | 400° C. | 10° C./min | 50 nm $10^9$ |

The following items can be qualitatively concluded from Table 4.

(1) As the contents of the organic metal compound increase, the density of the metal fine particles increases.

(2) As the firing rate is lower, the particle size of the metal fine particles increases.

(3) As the firing temperature increases, the particle size of the metal fine particles increases.

(4) By forming the metal fine particles by firing the organic metal compound and then coagulating the particles, still larger fine particles are formed.

(5) The particle size and the density of the metal fine particles are controlled within the ranges of 5–50 nm and $10^9$–$10^{11}$, respectively.

By thus controlling the particle size and the density of the metal fine particles, the particle size and the density of the electron emission bodies can be easily controlled as in the above-described examples.

The above-described samples 4-A, 4-B, 4-C, 4-D and 4-E were disposed in a vacuum chamber and electron emission devices having the same configuration as that of Example 1 were formed. Steps succeeding step 1 are as follows.

(Step 2)

Each sample of the first substrate 1 provided in step 1 was disposed in the vacuum processing apparatus shown in FIG. 6. After sufficiently evacuating the inside of the apparatus, the substrate 1 was heated at 150° C. while removing water and the like by evacuating the inside of the apparatus. Then, methane was introduced into the vacuum chamber while maintaining the pressure at 10 Torr. Then, the first substrate 1 was maintained at 650° C. for one hour.

(Step 3)

Then, the five samples of the first substrates 1 were maintained in an atmosphere including 100 mTorr of oxygen. At that time, a voltage was applied between the first electrode on the first substrate and the second electrode on the second substrate.

(Step 4)

Cs serving as a low-work-function material was deposited on the first substrates 1 in a vacuum. Cs was generated by disposing in advance cesium nitride in the low-work-function-material generating source 67 and heating the cesium nitride.

(Step 5)

Then, the five samples of the first substrate 1 were heated at 200° C. for 10 minutes. At that time, a voltage was applied between the first electrode on the first substrate and the second electrode on the second substrate.

The electron emission characteristics of the electron emission devices formed in the above-described manner were measured in the same manner as in Example 1. All of the devices emitted electrons. The electron emission current increases as the density of the fine partcles shown in Table 4 increases.

EXAMPLE 5

In Example 5, the image forming device having the first configuration of the present invention was provided using the electron emission devices of Example 1. A method for manufacturing the image forming device will now be sequentially described with reference to FIGS. 7(*a*)–7(*c*).

(Step 1)

By depositing Mo by a sputtering method to a thickness of 100 nm on the first substrate 1, obtained by depositing a silicon oxide film having a thickness of 0.5 μm on cleaned soda lime glass, according to a sputtering method, 500 parallel first electrodes 3 were formed. Then, after providing liquid droplets of an aqueous solution of nickel formate onto the first electrodes 3 in the form of the electron emission bodies 5 according to an ink-jet method, the liquid droplets were subjected to thermal decomposition in the air. The substance obtained by performing thermal decomposition of the liquid droplets provided by the ink-jet method had substantially the shape of a circle having a diameter of 110 μm.

(Step 2)

Each sample of the first substrate 1 provided in step 1 was disposed in a vacuum processing apparatus. After sufficiently evacuating the inside of the apparatus, the substrate 1 was heated at 150° C. while removing water and the like by evacuating the inside of the apparatus. Then, the first substrate 1 was heated at 350° C. in hydrogen in order to reduce fine particles of nickel oxide to provide fine particles of nickel metal. Then, methane was introduced into the vacuum processing apparatus while maintaining the pressure at 10 Torr. Then, the first substrate 1 was maintained at 550° C. for 25 minutes.

(Step 3)

Then, the first substrate 1 was subjected to plasma processing for 5 minutes by generating a plasma in an atmosphere including 100 mTorr of oxygen.

(Step 4)

After sufficiently evacuating the inside of the vacuum processing apparatus, Ba serving as a low-work-function material was deposited on the first substrate 1 in a vacuum.

(Step 5)

Then, the first substrate was heated at 250° C. for 1 hour.

Then, after depositing a material for the transparent electrodes 4 on the second substrate 2, 200×3 parallel second electrodes 4 were formed by patterning in the same manner as in the above-described step 1. Then, after coating the red, green and blue phosphors 6 according to a known slurry method, the same patterning as in the case of the transparent electrodes 4 was performed to provide the second substrate 2. The first substrate 1 and the second substrate 2 were bonded by frit glass using a spacer so as to maintain a distance of 250 μm between these substrates. An exhaust pipe was bonded to a portion near the first substrate 1 to provide a vacuum container.

After sufficiently evacuating the inside of the vacuum receptacle through the exhaust pipe, the vacuum container was heated at 300° C. for 2 hours while evacuating it. Finally, the exhaust pipe was chipped off to seal the vacuum container.

Then, the terminals of the first wirings 77 and the second wirings 74 on the first substrate 1 and the second substrate 2, respectively, of the display-panel shown in FIG. 7(*b*) were connected to drivers or the like. By inputting a television signal to the terminals, a color image could be displayed on the color flat panel.

According to the electron emission device of the present invention, a plurality of fine particles of an electron emission body obtained by terminating carbon bodies formed on metal fine particles with a low-work-function material via oxygen are partially disposed on an electrode on a substrate in a desired form, and an electrode where a voltage for drawing electrons from the emission body into a vacuum is disposed. Hence, it is unnecessary to perform three-dimensional processing of sharpening the distal end of an electron emission body and ultra-fine submicron processing of a gate electrode. As a result, an electron emission device which can emit electrons at a low electric field could be provided.

According to the method for manufacturing the electron emission device of the present invention, after applying a solution containing an organic metal on an electrode disposed on a substrate, the solution is heated to cause thermal decomposition in a desired atmosphere (also called firing), and to form metal fine particles, or fine particles including carbon fine particles and metal fine particles. Hence, it is possible to perform thermal decomposition of the solution including the organic metal at a low temperature to form the metal fine particles, to control the density of the metal fine particles by the density of the metal component of the solution containing the organic metal, and to control the particle size of the metal fine particles by controlling the density of the metal of the solution containing the organic metal, the shape of droplets, and the temperature of the thermal decomposition process. As a result, it is possible to form electron emission devices having an excellent controllability of the shape or the density as electron emission bodies and an excellent reproducibility which can be formed in a large area.

According to the display device using the method for manufacturing the electron emission device of the present invention, the above-described problems could be solved, and an electron emission device which can be driven at a low voltage and which has a high uniformity and an excellent mass production capability, and an image display device, such as a color flat panel or the like, having a excellent display quality which uses the electron emission devices could be provided.

The individual components shown in outline in the drawings are all well-known in the electron emission device and image display device arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for manufacturing an electron emission device, said method comprising the steps of:

(1) applying a solution containing an organic metal on an electrode disposed on a substrate, and then heating the solution in a desired atmosphere to cause thermal decomposition and to generate metal fine particles, or fine particles including carbon fine particles and metal fine particles;

(2) generating carbon bodies by introducing a material including carbon to the substrate and decomposing the material;

(3) terminating the surfaces of the carbon bodies with oxygen by heating the substrate or generating a plasma in an atmosphere including oxygen;

(4) coating the metal/carbon fine particles with a low-work-function material by introducing the low-work-function material to the substrate; and (5) heating the substrate.

2. A method according to claim 1, wherein in said step (1), the solution containing the organic metal is provided onto the substrate in a form of liquid droplets according to an ink-jet method.

3. A method according to claim 2, wherein the ink-jet method is a piezo-jet method or a bubble-jet method.

4. A method according to anyone of claims 1 through 3, wherein in said step (2), the material including carbon is a saturated hydrocarbon expressed by a composition formular of $C_nH_{2n+2}$, such as methane, ethane, propane or the like, or a cyclic hydrocarbon expressed by a composition formula of $C_nH_{2n}$, such as benzene or the like.

5. A method according to anyone of claims 1 through 3, wherein in said step (3), the atmosphere including oxygen is an appropriate atmosphere including oxygen, or oxygen and an inert gas (helium or the like) and/or $N_2$.

6. A method according to anyone of claims 1 through 3, wherein in said step (5), the heating temperature is a temperature equal to or higher than a temperature to allow a portion of the low-work-function material bonded with oxygen terminating the carbon to remain, and to remove an unbonded portion of the low-work-function material by evaporating it.

7. A method for manufacturing a display device, said method comprising the steps of:

(1) forming first wirings on a first substrate, then applying a solution containing an organic metal on the first wirings followed by heating the solution to cause thermal decomposition (also called firing), and to form metal fine particles, or fine particles including carbon fine particles and metal fine particles;

(2) forming second wirings and a phosphor on a second substrate;

(3) forming a vacuum container by supporting the first substrate and the second substrate by a supporting frame;

(4) forming carbon bodies by introducing a material including carbon on the first substrate and decomposing the material;

(5) causing the inside of the vacuum container to be an atmosphere including oxygen, and heating or generating a plasma to terminate the surface of the carbon bodies with oxygen;

(6) coating the metal/carbon fine particles with a low-work-function material by introducing the low-work-function material to the vacuum container;

(7) heating the vacuum container while evacuating it; and (8) sealing the vacuum container.

8. A method according to claim 7, wherein said steps are performed in the sequence of steps (1), (4), (5), (6), (7), (2), (3) and (8).

* * * * *

UNITED STATES PATENT AND TRADEMARK OFFICE

CERTIFICATE OF CORRECTION

PATENT NO. : 6,129,602
DATED : October 10, 2000
INVENTOR(S) : Masato Yamanobe

It is certified that error appears in the above-identified patent and that said Letters Patent is hereby corrected as shown below:

Title page,
Item [57], ABSTRACT,
Line 17, "alkaline" should read -- alkali --.

Figure 11A:
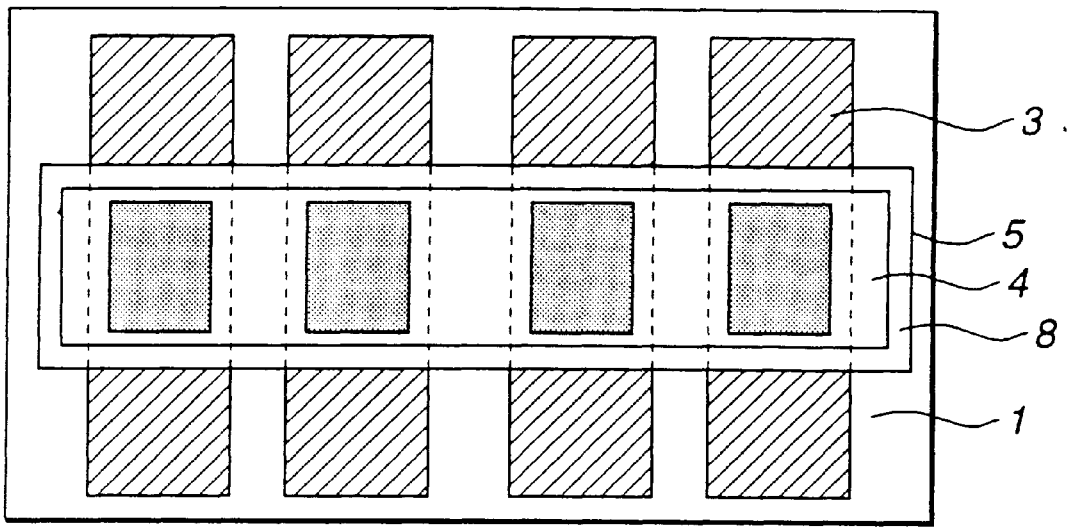
FIGS. 11(*a*) and 11(*b*) are schematic diagrams illustrating a second configuration of electron emission devices according to the present invention.
Figure 11B:
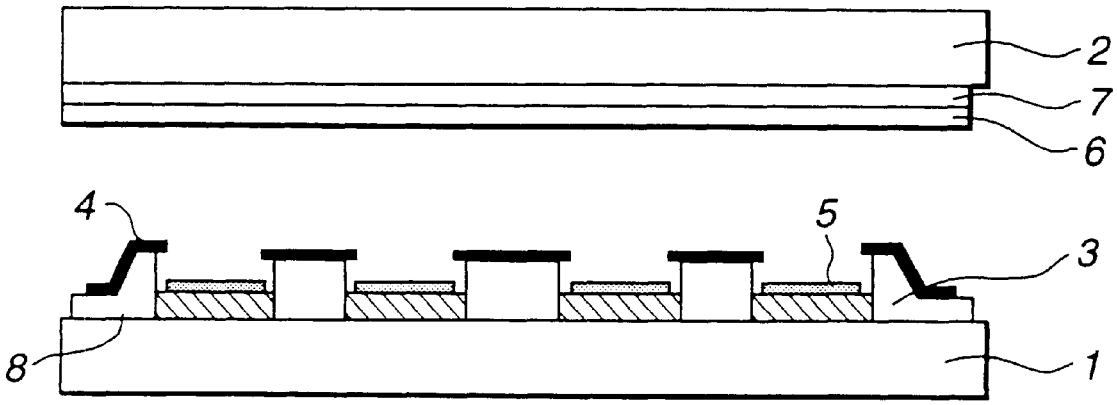

Sheet 10,
Figs 11a, 11b, FIGS. 11(a) and 11(b) should be replaced by FIGS. 11(a) and 11(b) on attached sheet.

Column 2,
Line 44, "positionded" should read -- positioned --.

Column 4,
Line 54, "diagram" should read -- diagrams --;
Line 64, "electrode" should read -- electrode --.

Column 5,
Line 31, "crystal" should read -- crystal --;
Line 49, "fine." should read -- fine --;
Line 65, "wherein an electrode where" should read -- featuring an electrode wherein --.

Column 6,
Line 11, "alkaline" should read -- alkali --.

Column 7,
Line 51, "unboded" should read -- unbonded --;
Line 66, "electron" should read -- electrons --.

Column 13,
Line 22, "are" should read -- is --.

Column 14,
Line 14, "is the same as these" should read -- are the same as those --.

Column 18,
Line 46, "samlples" should read -- samples --.

Column 20,
Line 66, "Ho" should read -- Mo --.

Column 21,
Line 17, "performs" should read -- perform --;
Line 67, "anyone" should read -- any one --.

UNITED STATES PATENT AND TRADEMARK OFFICE

CERTIFICATE OF CORRECTION

PATENT NO. : 6,129,602
DATED : October 10, 2000
INVENTOR(S) : Masato Yamanobe

It is certified that error appears in the above-identified patent and that said Letters Patent is hereby corrected as shown below:

Column 26,
Line 18, "anyone" should read -- any one --;
Line 20, "formular" should read -- formula --;
Line 24, "anyone" should read -- any one --;
Line 29, "anyone" should read -- any one --.

Signed and Sealed this

Fifteenth Day of January, 2002

*Attest:*

*Attesting Officer*

JAMES E. ROGAN
*Director of the United States Patent and Trademark Office*